US007078642B2

(12) United States Patent
Kowalik et al.

(10) Patent No.: US 7,078,642 B2
(45) Date of Patent: Jul. 18, 2006

(54) ARC EXTINGUISHING DEVICE WITH A HIGH SPEED WHIP

(75) Inventors: Peter M. Kowalik, Trafford, PA (US); Joseph K. Andreyo, North Huntingdon, PA (US); Arthur E. Bisig, North Huntingdon, PA (US); Charles M. Cleaveland, North Huntingdon, PA (US); Steven A. Cleaveland, Pittsburgh, PA (US)

(73) Assignee: Cleaveland/Price Inc., Trafford, PA (US)

( * ) Notice: Subject to any disclaimer, the term of this patent is extended or adjusted under 35 U.S.C. 154(b) by 131 days.

(21) Appl. No.: 10/788,961

(22) Filed: Feb. 28, 2004

(65) Prior Publication Data

US 2004/0173576 A1 Sep. 9, 2004

Related U.S. Application Data

(63) Continuation-in-part of application No. 10/342,035, filed on Jan. 14, 2003, now Pat. No. 6,762,385.

(51) Int. Cl.
*H01H 9/38* (2006.01)

(52) U.S. Cl. ..... 218/18; 218/14

(58) Field of Classification Search ..... 218/14, 218/18, 12, 2–8, 78–84, 43, 67, 71, 153, 218/154

See application file for complete search history.

(56) References Cited

U.S. PATENT DOCUMENTS 2,750,460 A 6/1956 Kast
2,769,063 A 10/1956 Lingal
2,849,578 A 8/1958 Hart
2,873,325 A 2/1959 Kelly
3,005,063 A 10/1961 Zemels et al.
3,032,632 A 5/1962 Beach et al.
3,217,115 A 11/1965 Kaplan
3,244,825 A 4/1966 Killian et al.
3,862,509 A 1/1975 Petersen, Jr.

(Continued)

*Primary Examiner*—Lincoln Donovan
*Assistant Examiner*—M. Fishman
(74) *Attorney, Agent, or Firm*—Gordon H. Telfer

(57) ABSTRACT

Rapid arc extinguishing devices for air break switches have a whip with at least an end portion of nonmetallic material such as fiber reinforced plastic with a conductive path on its surface. The nonmetallic material is a single tapered rod or an assembly of a plurality of rods successively inserted into an outer rod. The conductive path on the whip is of various individual and combination forms of which some include a metal braid, foil, sheath or wound wire. Particular forms of the conductive path on the rod have enhanced durability and arc resistance at the areas of the whip most likely to be subject to arcing with a latch of the device upon switch opening or closing. Further forms of the whip are a combination in which an end portion as described is attached to an all metal base portion that is arranged to include a portion of the whip subject to arcing on switch closing. Another form of device has a latch engaging a whip at a rotating wheel on the latch. Whips with conductors having metal strands are made with strands bonded to the nonmetallic rod surface for greater durability in use. Whips with an all metal base portion have a metal spine within its nonmetallic portion through the joint region between the two portions, to minimize risk of damage to the nonmetallic portion from high stress in that region when such a whip is released from a latch. Also, a latch with a wheel or roller is improved by a design that limits wear of the conductive path on a nonmetallic rod surface.

46 Claims, 11 Drawing Sheets

U.S. PATENT DOCUMENTS

| | | | | |
|---|---|---|---|---|
| 3,955,303 | A | | 5/1976 | Outlaw et al. |
| 4,080,643 | A | | 3/1978 | Cline |
| 4,170,014 | A | | 10/1979 | Sully |
| 4,238,800 | A | * | 12/1980 | Newington ..... 343/715 |
| 4,243,854 | A | | 1/1981 | Pahl |
| 4,379,298 | A | * | 4/1983 | Vincent et al. ..... 343/895 |
| 4,860,481 | A | | 8/1989 | Christenson |
| 4,945,333 | A | | 7/1990 | Stroud et al. |
| 5,186,315 | A | | 2/1993 | Koppe et al. |
| 5,359,167 | A | | 10/1994 | Demissy et al. |
| 5,369,234 | A | | 11/1994 | Demissy |
| 5,728,988 | A | | 3/1998 | Meinherz et al. |
| 6,392,181 | B1 | | 5/2002 | Cleaveland et al. |
| 6,791,504 | B1 | * | 9/2004 | Miller et al. ..... 343/750 |

* cited by examiner

ARC EXTINGUISHING DEVICE WITH A HIGH SPEED WHIP

CROSS REFERENCE TO RELATED APPLICATION

This application is a continuation-in-part application of application Ser. No. 10/342,035, filed Jan. 14, 2003 now U.S. Pat. No. 6,762,385, by P. Kowalik et al.

BACKGROUND OF THE INVENTION

1. Field of the Invention

This invention relates to arc extinguishing devices for electrical switchgear such as air break disconnect switches used in transmission and distribution lines.

2. Related Art

Patent 6,392,181, May 21, 2002, also assigned to Cleaveland/Price Inc., describes relevant background concerning use of high speed whips of all metal construction in arc extinguishing devices of switches and further describes such apparatus with whips comprising a nonmetallic material, such as a plastic polymer member, with a flexible conductive path. The patent describes embodiments capable of achieving faster separation (with less chance of arc restriking) of a whip with nonmetallic material as compared to an all metal whip that is otherwise similar.

All such description of the patent related to all metal whips of the background art and, also, whips with nonmetallic material newly presented in the patent, is incorporated herein by reference. Reference is also made to commonly assigned copending application Ser. No. 10/431,700, filed May 8, 2003 by one of the present inventors, that describes arc extinguishing devices with a metal matrix composite high speed whip.

SUMMARY OF THE INVENTION

The present invention is directed to apparatus generally like that of the above-mentioned patent, with a whip comprising a nonmetallic material, such as a plastic polymer, with a flexible conductive path, with newly disclosed embodiments of the whip itself and, in addition, of the latch or hook element that the whip makes conductive contact with during initial main contact separation.

Some of the various example embodiments of the invention include one or more of the following innovative features.

A whip in one form comprises a plurality of tapered nonmetallic rods that fit inside one another. For example, a first hollow rod has one or more additional tapered rods telescopically fit together inside the first rod forming a rod assembly. At least all but the final, inner, rod is hollow. Only the outermost rod needs to be provided with a conductive path. The plurality of rods can be of the same nonmetallic material and have the same taper dimensions. Fitting the rods together only requires a second rod to be inserted in the first rod to the extent the first and second rods' dimensions allow, generally with the tip of the second rod at least halfway through the length of the first, and the tip of a third, if any, at least halfway through the second. Most often the extent of the inserted rod is about 75% to 90% through the length of the adjacent outer rod. The assembled rods are terminated at a common blunt end. In some embodiments three or four rods have been so assembled and have exhibited good characteristics but the number of rods may be varied.

An assembly of multiple rods as described is considered to perform similar to a leaf spring with an increase in accelerating force, compared to use of a single rod like the first rod of the assembly, while still retaining flexibility. The multiple rods also can be more resistant to breakage than a single unitary rod of the same overall dimensions as the multiple rods.

Such an assembly of multiple rods is provided with a conductive path for engaging with a latch of an arc extinguishing device such as described in the above patent and in other descriptions below. For example, the outer surface of the first rod has some form of a conductor layer on it.

The conductive path on the outer rod of the rod assembly (or a single rod where only one is used) can be formed in numerous different ways to achieve desired conduction between the whip and the latch and between the latch contact point and the attachment of the whip to the switch contact arm, all while the nonmetallic rod supporting the conductive path still retains substantial flexibility so it can provide higher separation speed from the latch.

The forms described herein for the conductive path on the nonmetallic rod include, for example, at least one conductor selected from the group consisting of a metal braid (e.g., tubular metal braid held to the rod by its own elasticity), a metal foil (e.g., a wrapping of an adhesive backed thin foil layer), a metal sheath (e.g., a conductive tubular element into which the nonmetal rod fits securely), and a wound metal wire. Various examples, including combinations of some of the foregoing conductors, will be described, of which some are particularly designed to enhance the durability of the conductive path where arcing is initiated between the whip and the latch upon switch closing and also at the tip of the whip that finally separates from the latch.

Among embodiments of the invention are those in which a nonmetallic portion of a whip, such as a rod assembly with the multiple rods above described or a single nonmetallic rod, is assembled with an all metal base portion with the metal portion extending, for example, from a point of connection on a switch contact arm to a point above an area on the whip at which it first conducts when the switch contacts open and also where it first has a close air gap with the latch during switch closing. In such embodiments, the metal base portion can be like the base part of the prior art all metal whips. A whip with an all metal base can allow repeated switch operations with as much durability as prior whips entirely of metal. The whip portion with a nonmetallic rod plus a conductive path at the tip end of the whip can give favorable separation speed of the whip from the latch to minimize arcing on switch opening. The metal base portion can also contribute to increasing the separation speed by storing spring force during flexing of the whip.

A further feature of the invention involves a modification of the latch of the device so it has a wheel that engages the whip during part of a switch opening. The rolling wheel surface is the final release point for the whip from the latch. It can reduce the sliding wear between the latch and the conductor on the whip surface. The wheel (or roller) rotates on a pin that is secured at one end to a rod portion of the latch. In some embodiments the other end of the pin for the wheel is joined with a cam bar to help make more sure that during switch opening the whip has final contact and arcing at its tip with the wheel on the latch and that during switch closing the whip does not engage the wheel in a manner likely to damage its conductive path.

Additional or alternative features of the invention include having a conductor on the nonmetallic rod with metal strands (e.g., a metal braid or a metal wire along or around the rod) that are bonded to the rod by an adhesive. Such a combination can aid in minimizing wear or tearing of the metal strands. The adhesive can be one with resinous material containing metal particles for a degree of conductivity that can be desirable. Since such an adhesive is likely not to have as high conductivity as the metal strands themselves, it is desirable to make the outermost surface of the strands substantially free of the adhesive where engagement with the latch occurs.

Also, the assembly of multiple rods, or a single nonmetallic rod, joined with an all-metal base portion of the whip can have greater strength to withstand and distribute the high stress on the rods, or rod, at the joint with the all-metal portion when the whip releases from the latch by having a metal spine in the inner hollow of the rod or rods in the region of the joint.

Arc extinguishing devices with whips that include a rod comprising a metal matrix composite (MMC) material, such as are disclosed in the above-mentioned copending application Ser. No. 10/431,700, filed May 8, 2003, can utilize features like those described for a whip comprising a nonmetal, such as FRP, with a conductive path on its surface.

These and other aspects of the present invention will be further understood from the entirety of the description, drawings and claims.

DETAILED DESCRIPTION OF THE INVENTION

Figure 1A:
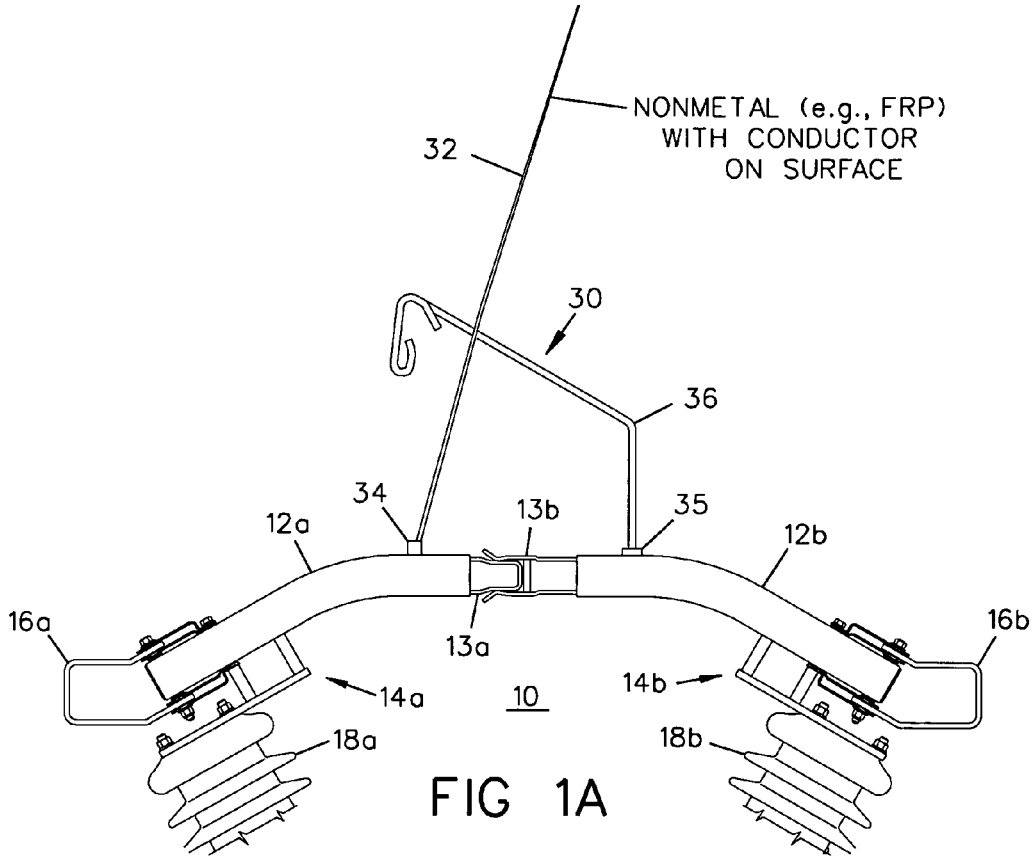
FIG. 1A is a front elevation view, partly broken away, of a switch with an arc extinguishing device.
Figure 1B:
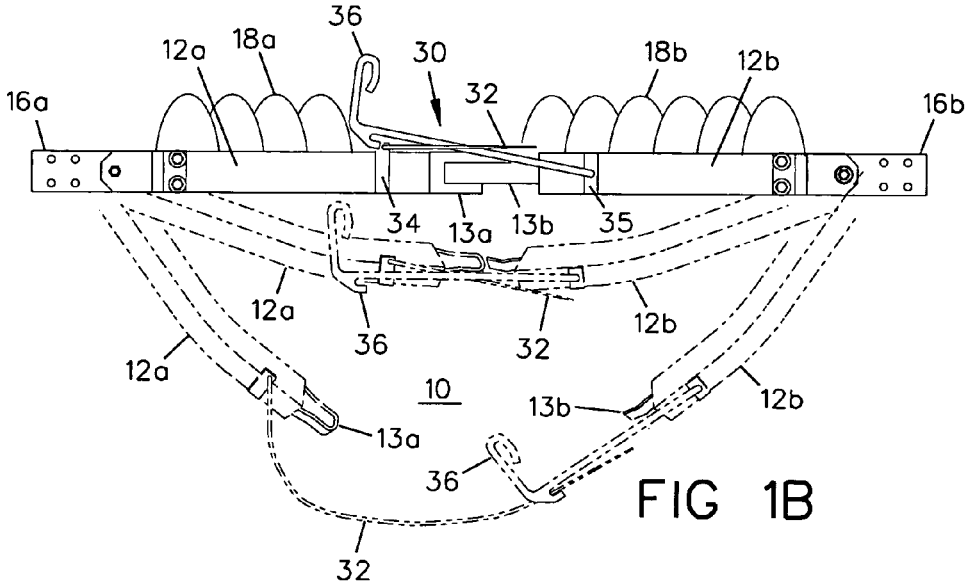
FIG. 1B is a top view of the apparatus of FIG. 1A with certain parts shown in phantom at positions resulting from movement during switch operation.

FIGS. 1A and 1B show an air break switch 10 incorporating a general form of the present invention for a general orientation of some key elements of an example switch to which the invention can be applied. The switch 10 is one referred to as a center break switch. FIG. 1A and the solid line view of FIG. 1B show the switch 10 in its closed position. Some elements of the switch 10 include, substantially in accordance with prior art:

a pair of movable switch arms 12*a* and 12*b;* contacts 13*a* and 13*b* on the respective arms 12*a* and 12*b* where, when switch 10 is closed, contact 13*a* fits within and engages contact 13*b* that is jaw-like;

pivotal or hinge-like arm supports 14*a* and 14*b* for the respective arms;

line terminals 16*a* and 16*b* respectively conductively connected to the switch arms 12*a* and 12*b* near the arm supports 14*a* and 14*b;* insulators 18*a* and 18*b* respectively supporting each half of the switch 10; and a switch operating mechanism (not shown) that is arranged at the lower ends of the insulator supports 18*a* and 18*b* to produce rotational motion of the supports 18*a* and 18*b* and the elements they support.

The basic elements of the switch 10 can, for example, be in accordance with prior air break switches such as a "V" Configuration Center Break Switch as described in Cleaveland/Price Bulletin DB-126A02 (issued 2002). The invention may also be practiced with other air break switches such as a center break switch with parallel (rather than "V" configured) support insulators as described in that Bulletin and, also, a vertical break switch as described in Cleaveland/Price Bulletin DB-106BH97 (issued 1997), both of the referred to Bulletins are herein incorporated by reference for their description of such switches.

FIGS. 1A and 1B also show a rapid arc extinguishing device 30, a type of device sometimes referred to in the art as a "quick break whip" (although it includes more than a whip alone).

The device 30 includes a whip 32 and, in this example, an attachment (e.g., a clamp) 34 fastening the whip 32 at its lower end to the arm 12*a*. The device 30 also includes a latch (or hook) 36 conductively joined by a latch attachment 35 with the arm 12*b*. In this example, the latch 36 includes a rod extending up with a bend and with a loop portion at the free end. That represents a general form for the latch 36. Further discussion of forms of the latch 36 will be found below.

By the present invention, and also consistent with the above-mentioned U.S. Pat. No. 6,392,181, the geometry of the elements of the device 30, and their relation to the rest of the switch 30, can be generally like prior "quick break whips" but with a difference in the structure of the whip 32 itself from formerly used all metal whips. In FIG. 1A, the whip 32 is accompanied by a legend designating it as a whip with a conductor on a nonmetal (e.g., plastic or fiber reinforced plastic, commonly referred to as FRP). As will be seen in subsequent drawings and description, the entire whip 32 can have that kind of structure but it has most important effect at the tip end of the whip. Consequently, some embodiments to be discussed have a tip portion of a nonmetal with a surface conductor while a base portion of the whip is different, e.g., by being of all metal.

During an opening of the switch 10, by the mechanism associated with the support insulators 18*a* and 18*b*, the arms 12*a* and 12*b* swing toward the viewer, relative to their orientation in FIG. 1A, as represented by the phantom views of FIG. 1B. In the first phantom view of FIG. 1B, the contacts 13*a* and 13*b* have just slightly parted. Under power, a substantial amount of deleterious arcing could occur between the contacts 13*a* and 13*b* if the arc extinguishing device 30 is not present. However, the contact between the whip 32 and the latch 36, which is a rubbing or sliding conductive engagement, can avoid an arcing problem between the contacts 13*a* and 13*b*, with arcing directed to the whip and latch.

In the second phantom view of FIG. 1B, the contacts 13*a* and 13*b* are now well apart and reasonably safe from arcing. Electrical conduction is still occurring between the whip 32 and the latch 36 and the whip 32 has flexed into a curved shape with increasing spring force. Upon further movement of the arms 12*a* and 12*b* (not shown), the whip 32 separates from the latch 36 and rapidly separates due to the stored spring force. Arcing that may occur between the tip end of the whip 32 and the latch 36 can be more rapidly extinguished, due to the high speed of separation, than with a prior art whip entirely of metal.

Normally in arc extinguishing devices 30 like that of FIGS. 1A and 1B, the whip 32 and latch 36 are conductively engaged even in the closed, stationary position and remain engaged until the whip is released from its flexed position. Minimal arcing normally occurs during opening of the switch before the whip releases. Upon switch closing a portion of the whip 32 removed from the tip end makes initial arcing contact with the latch 36. The intersection of the whip 32 and latch 36 depicted in FIG. 1A gives an idea where arcing on closing is likely to occur. More on that aspect of the whip's operation will be discussed later.

Switch 10 is of course merely an example of an air break switch with an arc extinguishing device 30 having an improved whip 32. Generally, such a device 30 can be adapted to any switch whose operation can present arcing problems, at least to the same extent as prior metal "quick break whips". The above referred to product bulletins show examples of other switches. In a vertical break switch there is, as shown in the above-mentioned patent, normally one movable contact arm, having a whip attached to it, and a latch attached to a stationary contact.

As indicated on FIG. 1A, the whip 32 has a structure of a nonmetal with a surface conductor. The nonmetal can be principally some member of the general class of material known as fiber reinforced plastic (often referred to as FRP). Such materials are readily available in a variety of forms. For general information on such material and its manufacture, see, for example, "FRP Materials, Manufacturing Methods and Markets" in Composites Technology, 2002 Yellow Pages, pages 6–17, June 2002, which is herein incorporated by reference for its description of such materials and techniques related to them. More generally, however, other nonmetallic material having the flexibility and strength for achieving good separation speeds, especially those superior to metal, can be used in the whips of the invention, e.g., other plastics (or polymers) that are not fiber reinforced or even other nonmetallic materials that are not plastic. Therefore, in the description of the improved whips, the nonmetallic material of the whip may be understood as suitably FRP but without being limited to FRP.

In the drawings, similar elements will normally have the same last two digits.

Figure 2A:
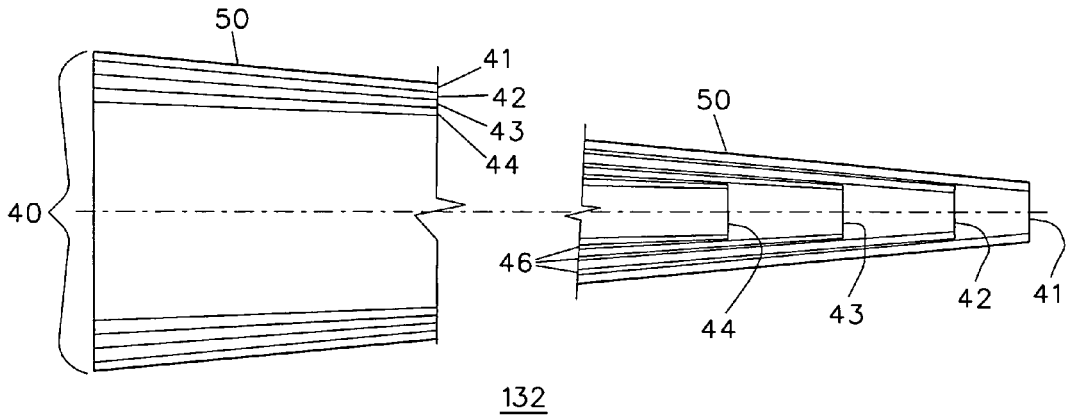
FIG. 2A is an enlarged sectional view, partly broken away, of a whip for an arc extinguishing device.

FIG. 2A (along with the partial blow-up of FIG. 2B) shows an example of a whip 132 whose entire length has a rod assembly 40 of a plurality of flexible nonmetallic rods 41, 42, 43, and 44 fit together by being inserted inside one another. In this example, each of the four rods 41, 42, 43 and 44 have the same dimensions except their length, as will be described. At least from their tip ends (at the right in FIG. 2A) back a distance (to the left), the rods all have the same taper, wall thickness and cross-section. That fact limits the extent to which one rod can be inserted inside another. The rods 41, 42, 43 and 44 are all hollow and tapered. Starting with the first, outer, rod 41, a second rod 42 is inserted within rod 41 substantially as far as it will go, i.e., until the wall of rod 42 is impeded by the wall of rod 41. Likewise, a third rod 43 is inserted in the second rod 42 and a fourth rod 44 is inserted in the third rod 43.

In forming the rod assembly 40, the order of the insertions can be varied from the above, e.g., first insert the fourth rod 44 into the third rod 43, then that combination into the second rod 42, etc. In any case, when assembled, the inserted rods 42, 43, and 44 all end proximate the blunt end of the first, outer rod 41 (by either starting with the same length for all the rods prior to the insertions and cutting the assembly at the desired length after the insertions or cutting individual rods prior to the insertions so their length is correct afterward). At the blunt end of the rod assembly 40, all the rods are in direct contact, providing enhanced strength. At the tip end of the rod assembly, all the tip ends of the rods are spaced from each other.

Figure 2B:
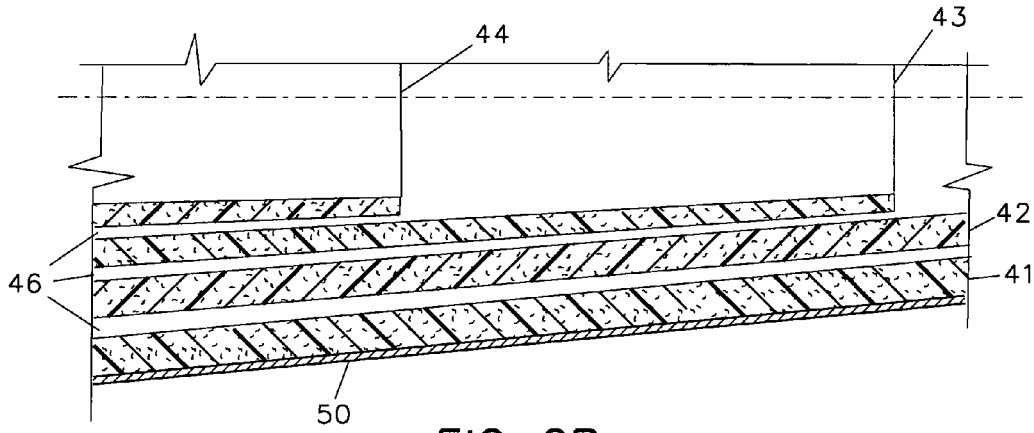
FIG. 2B is an enlarged view of part of the whip of FIG. 2A.

FIGS. 2A and 2B shows a conductor 50 on the outer surface of the outer rod 41. The conductor 50 is the conductive path between the tip of the rod 41 and its blunt end that is attached to a switch contact arm (e.g., arm 12*a* in FIG. 1). Conductor 50 can take any of a variety of forms including, for example, those subsequently described herein and those described in the above patent.

A rod assembly of multiple rods for the whip 132 need not consist of four rods, for example two or three rods, or even more than four rods might be used in some embodiments.

It has been found that a multiple rod assembly, such as assembly 40, can increase the speed of a whip with reduced chance of breakage as compared to a whip with just one rod (such as rod 41). An explanation, although not necessary to the successful practice of this aspect of the invention, is that the addition of the mass of the conductor 50 reduces the whip speed compared to the speed of a single rod without a conductor but that reduction in speed is offset by an inserted rod or rods. It is believed the rod assembly 40 acts much like an automotive leaf spring, still exhibits a high degree of flexibility, increases the accelerating force on the tip of the outer rod 41 and is strong and less likely to break than a single rod of the same wall thickness as the multiple rod assembly. A multiple rod assembly 40 allows a wide choice of the conductor 50. The strength of rod assembly 40 can facilitate supporting a heavier conductor for good arc resistance.

Example dimensions for a single rod given in the above patent are also relevant in the embodiments here, such as for rod 41, 42, 43 or 44. With a multiple rod assembly, the extent of an inserted rod is likely to be about 75% to about 90% of the distance to the tip of the next adjacent outer rod, where the rods have the same basic dimensions.

While it is not presently preferred to have a variety of rod shapes in the rod assembly 40, requiring a multiplicity of different parts to be procured, the intention is not to preclude that possibility. Likewise, it is convenient, but not essential, that the multiple rods all have the same nonmetallic material composition. Also, it is evident that the innermost rod of the assembly, the fourth rod 44 in FIG. 2, need not be hollow.

In FIGS. 2A and 2B, it is seen that the assembly 40 of substantially uniform rods 41, 42, 43, and 44 leaves gaps 46 between adjacent rods (except where direct contact is made at the blunt ends). The gaps 46 need not be filled but can be (partially or fully), for example, if desired to achieve a greater strength assembly with some sacrifice in flexibility, such as with an epoxy resin.

Figure 3:
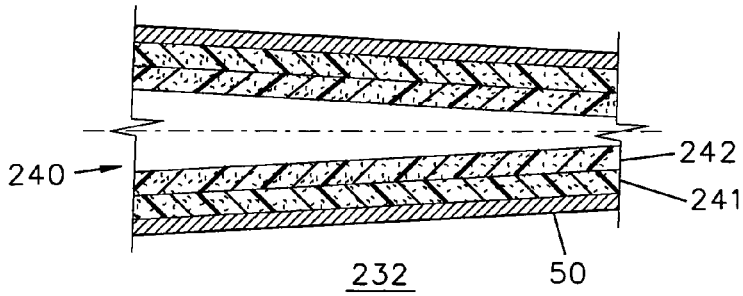
FIG. 3 is a partial sectional view of another whip embodiment.

A further variation is shown in FIG. 3 where a whip 232 comprises a rod assembly 240 of rods (just two in this example but there could be other numbers) where a second rod 242 fits within a first rod 241 (having conductor 50 on its outer surface) without leaving an appreciable gap, that is, the second rod dimensions are different than the first rod's such that it fits within rod 241 with near congruence between its outer surface and the inner surface of the first rod. Sliding between the rods 241 and 242 can occur as the whip is bent, where there is no adhesive between the two rods.

The conductor 50 has characteristics to allow the nonmetallic rods of a multiple rod assembly, or a single rod, to have a conductive path along its length while retaining a substantial flexibility. Also, the conductor 50 is chosen to withstand numerous instances of arcing that will inherently occur in operation, at least at certain areas along its length.

Referring again to FIGS. 1A and 1B, there are two key areas along the length of the whip 32 where good arc resistance is particularly important. One is where the whip surface is closest to the latch 36 upon closing of the contacts 13*a* and 13*b*. The other is the extreme tip of the whip that is the last to separate from the latch 36 on switch opening. For a particular device 30, the conductor of the whip 32 may be uniform over the length of the nonmetal rod or it may be varied to provide extra arc resistance in the key areas. Further, the conductor 50 may be of a combination of individually applied conductors.

In the above mentioned patent, various suitable conductors were disclosed including, for example, metal deposited by electroplating or vapor deposition, perhaps over a layer of conductive paint. Other examples will now be described.

The conductor 50 of FIGS. 2A, 2B and 3 can, for example, be a layer applied as a metal foil or a metal sheath. A metal foil can be wrapped about the outer rod surface, e.g., by wrapping a tape of a metal foil with adhesive backing in one or more layers. Suitable copper tapes, for example, are readily available.

A metal sheath for the conductor 50 could be formed (e.g., into tubular form) before being fitted on the rod surface. The conductors referred to need not be continuous along the length of a whip as long as there is conductive continuity. For example, a whip 32 could have a layer of metal foil over its length and have limited areas of metal sheath at the areas mentioned above where it can be desirable to have enhanced arc resistance. The metal of a sheath may be chosen, for example, from conductors such as copper, aluminum, stainless steel or, for even greater arc resistance, titanium.

Figure 4:
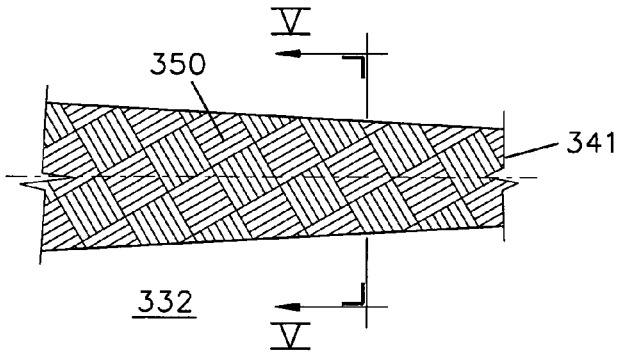
FIGS. 4 and 5 are, respectively, a partial side elevation view and a sectional view of a whip embodiment, with FIG. 5 enlarged in relation to FIG. 4.
Figure 5:
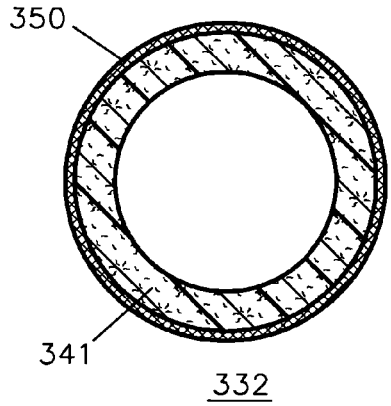

FIGS. 4 and 5 show a different form of conductor on a whip 332. The whip 332 has a nonmetal rod structure 341 (representative of a single rod or of the outer rod of a multiple rod assembly) with a conductor 350 that is (or includes) a metal braid. Tubular braid of various metals is widely available from wire and cable suppliers for such purposes as electromagnetic shielding, grounding bonds and connections to motor brushes. Such commercial products can be used for conductor 350 even though the tubular configuration is not tapered; the braid has a formability sufficient for it to fit on and adhere to a tapered rod. The rod can be put inside the braid and the braid stretched to give a tight fit on the rod. The braid ends are then twisted and, possibly, tied or clamped to be held on the rod. Braids of a wide variety of metals from highly conductive silver or copper to highly durable stainless steel or titanium, or a combination of both, can be used.

As the metal braid is stretched over the rod, openings between strands of the braid can occur exposing the surface of the rod. For some installations, where exposure to sunlight might be deleterious to the nonmetal material of the rod, the rod can have an outer surface that is not homogeneous with the inner material and is more sunlight (UV) resistant. Avoiding sunlight effect on the rod is also taken care of by the example of FIG. 6.

Figure 6:
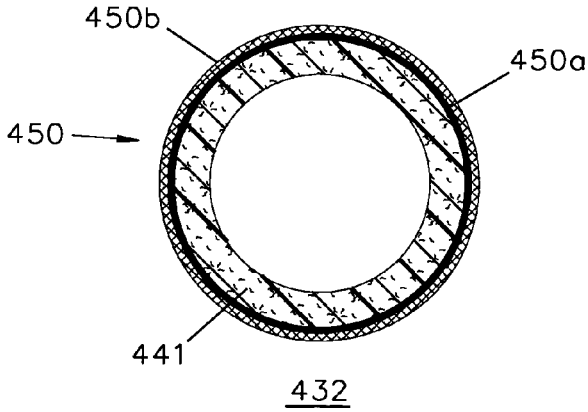
FIG. 6 is a sectional view of another whip embodiment.

FIG. 6 shows a whip 432 with a rod 441 (a single rod or the outer rod of a rod assembly) having a combination conductor 450 including a first, inner, conductor layer 450*a* over the rod surface that may be, for example, an electroplated metal (which may itself be over a conductive paint, not shown) or a wrapped foil tape and, over the first layer 450*a*, a conductive metal braid 450*b*.

Figure 7:
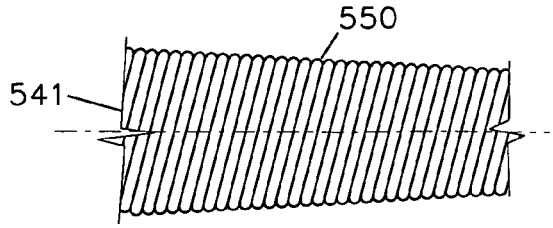
FIGS. 7, 8, 9, 10, 11, and 12 are partial side elevation views of some whip embodiments.

FIG. 7 shows a part of a whip 532 with a still different form of a conductor which is a wound wire, or wire spring, 550 over a rod 541. The wire is preferably of small diameter and is wound with immediately adjacent turns for smoother contact with a latch.

Figure 8:
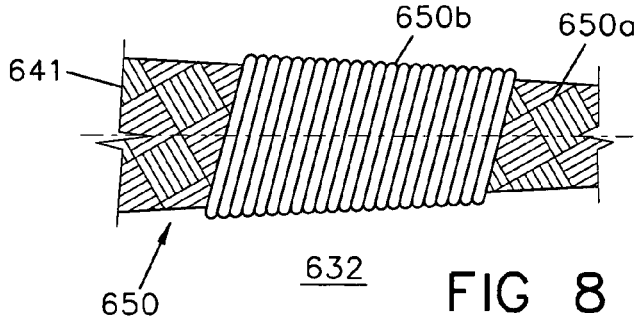

FIG. 8 shows a part of another whip 632 with a combination conductor 650 comprising first a layer of metal braid 650*a* on a rod 641 and additionally, over the braid 650*a* in a region of the whip length, a wound wire 650*b*, for example, where desired to give additional arc resistance.

Figure 9:
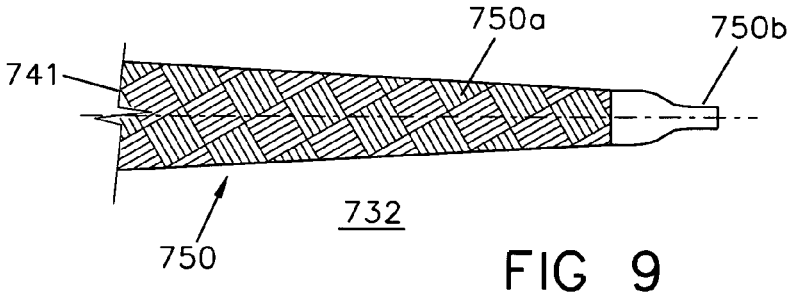

FIG. 9 shows a further example of a whip 732 which at the tip portion of a rod 741 has a conductor 750 comprising a metal braid 750*a* and, at the tip end, a metal cap or sheath 750*b* over the braid 750*a*. In this example, the cap 750*b*, which may be of a highly durable conductor such as titanium, has, in addition to the part having direct contact to the braid 750*a*, a pointed tip extending beyond the end of the rod for additional thermal mass to inhibit arc melting. (An extended portion of cap 750*b* beyond the end of the rod need not have a step change in its outer dimension from the part of the cap directly on the rod.).

From these examples, it can be seen that a conductive path on a nonmetal rod for a whip can be of various forms and combinations, including those shown and others. The example conductors particularly show how the conductive path on a nonmetal rod surface can comprise, in addition to the examples of the above patent, at least one conductor selected from the group consisting of a metal braid, a metal foil, a metal sheath, and a wound metal wire. From the variety of available conductors and rod constructions, one has choices in order to attain sufficient arc resistance, particularly in areas of greater concern, while retaining strength and flexibility for high speed separation.

Figure 10:
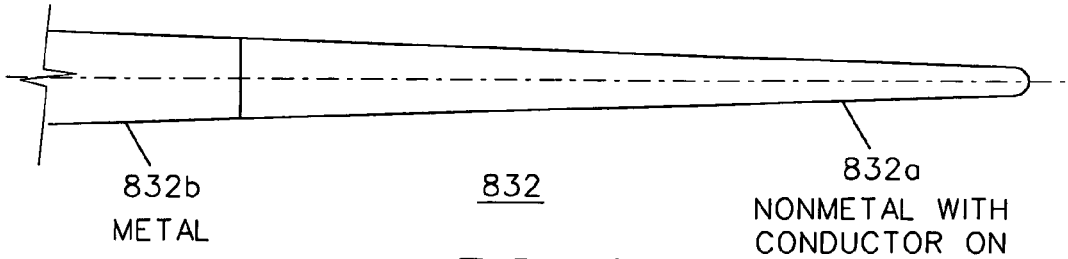

A further form of the invention is shown in FIG. 10. A whip 832 has two parts including a whip end portion 832*a* with a conductor on one or more nonmetal rods as previously discussed and a base part 832*b* that is of metal (or "all metal"; without a plastic or other nonmetal rod) of a length so it extends to a region that is where initial arcing between the whip 832 and a latch, such as latch 36 of FIG. 1A, will occur upon switch closing. The metal portion 832*b* can, for example, be like a lower portion of a metal whip of the prior art that is joined with the whip end 832*a* a short distance beyond the switch closing arcing area. The whip 832 can achieve higher speed separation from a latch by the tip portion 832*a* than a conventional whip that is all metal over its entire length, while enduring initial arcing during closing just as well as a conventional all metal whip. Higher speeds can result from a combination of the lower weight characteristics of the nonmetal portion 832*a* and the higher acceleration of the portion 832*a* by the spring force of the metal portion 832*b*. (Sometimes prior art metal quick break whips were arranged in a combination with a coiled accelerator spring to try to get higher speed separation. That is not considered necessary in practicing the present invention but such a device may be used if desired.) (To avoid undue wordiness, reference to the "metal" portion of the whip or the "all metal" portion are both to be understood to mean at least "substantially all metal" or "consisting essentially of metal". Practice in the past with "metal" whips has been with 100% metal which is also preferred here for the metal portion.)

Suitable compositions for the metal part 832*b* include, for example, beryllium-copper, stainless steel, and others used in prior metal whips. Generally, metal part 832*b* need not be solid; it could be tubular but solid metal rods, either tapered or of uniform cross-section are often more readily available and less expensive.

Figure 11:
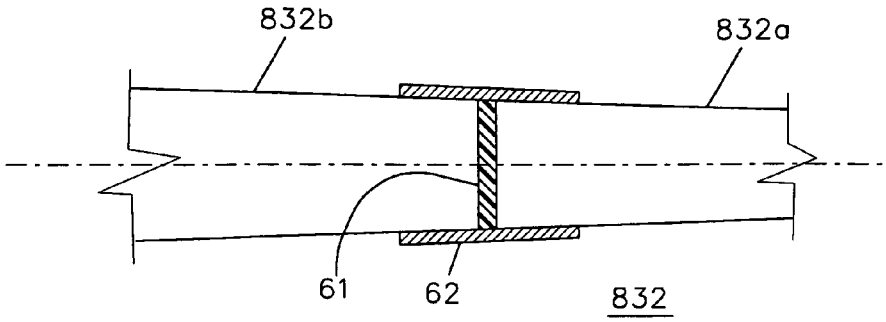
Figure 12:
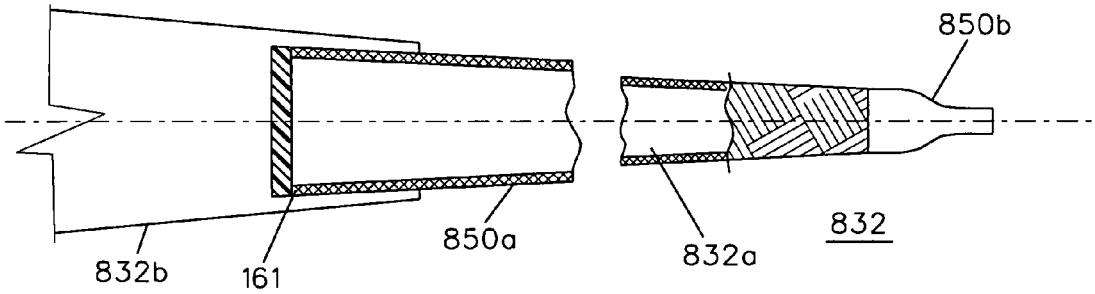

FIGS. 11 and 12 show examples of joints between parts 832*a* and 832*b* of a whip 832.

In FIG. 11 the opposing ends of the two parts 832*a* and 832*b* are attached by an adhesive layer 61, e.g., a conductive epoxy resin, and a formed metal conductor such as a metal sheath 62 is applied tightly over the ends of the two parts and the adhesive layer. The sheath 62 can, for example, be preformed with a taper to tightly connect the two parts of the whip or can be crimped on (e.g., when starting with an untapered tube for the sheath).

In the example of FIG. 12, the end of the metal whip part 832*b* has an axial bore or socket into which the blunt end of the whip part 832*a* is inserted and bonded, such as by an adhesive layer 161. In this example, it is also shown that the nonmetal whip part 832*a* has a metal braid conductor 850*a* over its length that contacts both the metal of whip part 832*b* and a cap 850*b* at the extremity of part 850*a*. The bore wall material of whip portion 832*b* is shown crimped into close contact with the braid 850*a* securely attaching the two parts together.

Examples such as are shown in FIGS. 11 and 12 for joints between whip parts 832*a* and 832*b* can be smoothed by machining to run smoothly against a latch. However, a small step in the whip geometry is acceptable.

Figure 13:
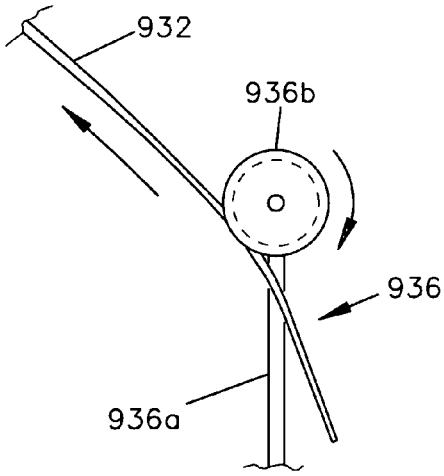
FIG. 13 is a partial elevation view of a whip and latch of an arc extinguishing device.

An example of a further variation or optional feature for a "quick break whip" type of arc extinguishing device is shown in FIG. 13. This shows a whip 932 in relation to a part of a latch 936. In this generalized view, the latch 936 comprises a conductive support, e.g., a rod 936*a* in conductive contact with a switch contact, such as shown for latch 36 in FIG. 1A. The rod 936*a* has a rotatable conductive wheel 936*b* mounted on it, such as by a conductive pin on the center of the wheel that makes electrical connection between the wheel and the rod 936*a*. In the position shown in FIG. 13, the whip 932 is in motion, as shown by the arrow along its length, as a contact arm, such as arm 12*a* of FIG. 1A or 1B, moves to its full open position. During the motion of the whip 932 it runs along the circumference of the latch wheel 936*b* (e.g., within a circumferential groove as shown by the dashed line) and the wheel rotates, as shown by the arrow near its rim.

An arrangement like that of FIG. 13, which may be applied to quick break whip apparatus with whips of any structure, can help improve whip wear life, as well as reduce the necessary operative force of a switch opening mechanism. The rolling surface of the wheel 936*b* can reduce the drag force or friction present when a quick break whip 932 begins to cock or charge as a switch begins to open. The wheel surface can thus reduce sliding wear on the whip 932 so that a thinner, lighter form of conductive path can last longer.

Embodiments such as FIG. 13 with a wheel 936*b* on the latch 936 can be arranged so that, on switch opening, the whip 932 stays in contact with the latch rod 936*a*, as it is in the switch closed position, for an initial part of the switch arm movement, such as represented in the first phantom view of FIG. 1B. Subsequently, such as in the second phantom view of FIG. 1B, if a wheel is provided on the latch 36, the whip has transferred from the rod 936*a* to the wheel 936*b* with which it stays in contact until the whip releases from the latch. It is preferable to arrange the whip and latch (with or without a wheel) with geometry so they have substantially continuous contact from the stationary position to the final release. For example, if the whip were to bounce or have oscillating contact with the latch, additional arcing is likely to occur imposing more severe duty on the conductor along the length of the whip.

The wheel 936*b* can be of a metal such as brass or copper. Also, carbon can be used for lubricity and added life to the wearing surface of the whip.

Figure 14A:
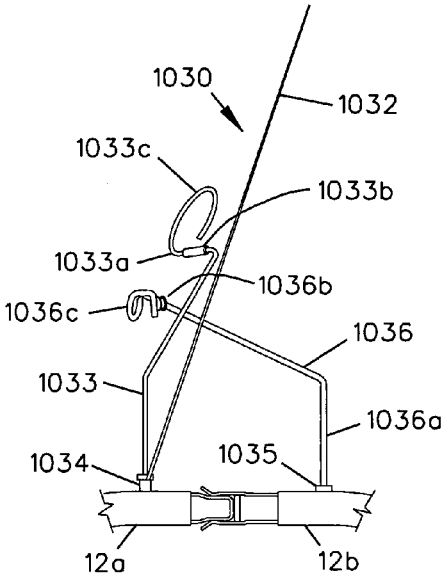
FIG. 14A is a front elevation view, partly broken away, of a switch with an arc extinguishing device.
Figure 14B:
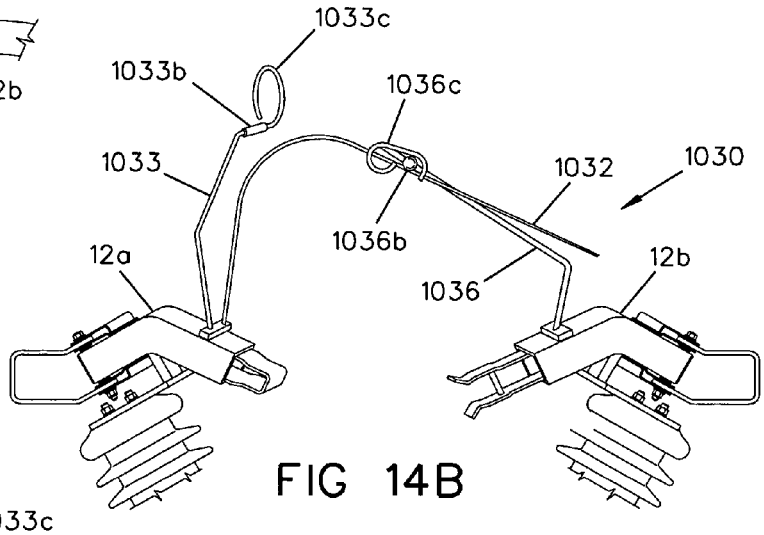
FIGS. 14B and 14C show the switch of FIG. 14A at different stages of a switch opening operation.
Figure 14C:
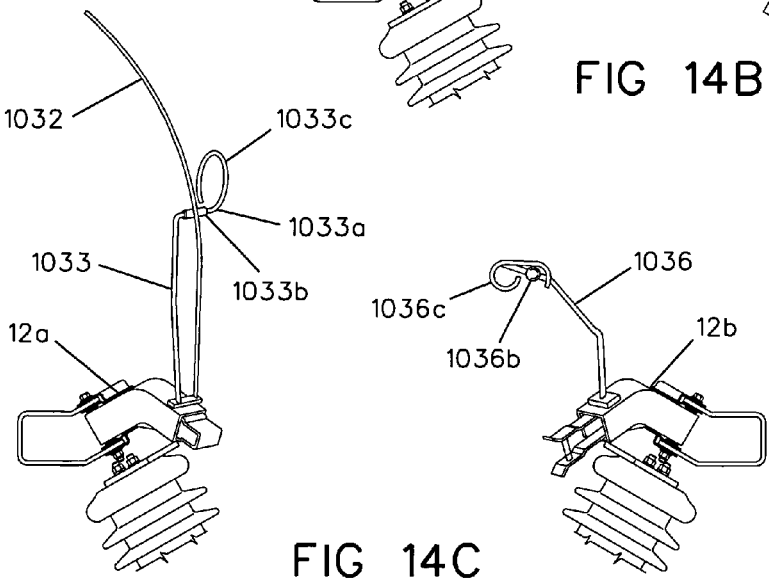

FIGS. 14A, 14B and 14C show a further example of an arc extinguishing device 1030. FIG. 14A is in a closed switch position (e.g., contacts mounted on contact arms 12*a* and 12*b* of switch 10 of FIG. 1A are closed). FIGS. 14B and 14C show two positions the elements take during an opening operation.

The device 1030 includes a whip 1032, that is of some form of the previously discussed whips, a latch 1036, and an additional part referred to here as a bumper rod 1033.

The latch 1036 is generally similar to the latch 36 of FIG. 1A but with the addition of a wheel similar to that of FIG. 13. It has a latch rod 1036*a* that is attached at its lower end to the contact arm 12*b* by an attachment 1035. At the extremity of the rod 1036*a* away from the contact arm, the rod has a loop 1036*c* that can be like or similar to configurations of latch rods of prior art devices. The loop 1036*c*, particularly at the left, helps to reduce the voltage stress that may occur when the switch is opened. The surface of the loop 1036*c* is where initial contact with the whip 1032 occurs upon switch closing and the right portion of the loop 1036*c* provides a camming surface so the whip slides along the surface onto the surface of a straight portion of the rod 1036*a* bypassing the wheel 1036*b* as the switch closes.

The bumper rod 1033 is an example of another element in an arc extinguishing device 1030 for a center break switch. In this example, bumper rod 1033 is substantially rigid like the latch rod 1036*a* (i.e., compared to the whip 1032) and is attached to the contact arm 12*a* by an attachment 1034 that can be the same location as the attachment for the whip 1032. The rod 1033 extends up from the arm 12*a*, past the location where the whip 1032 and the latch 1036 contact each other, to a laterally extending portion 1033*a* with a bumper 1033*b* on it following which there is a loop 1033*c* of the rod.

The loop 1033*c* of the rod 1033 is to reduce voltage stress. The bumper 1033*b* is located so that after an opening of the switch, and the tip of the whip 1032 has released from the latch 1036, the whip's motion away from the latch is limited in magnitude by the bumper (FIG. 14C). When the whip strikes the bumper, mechanical energy is dissipated from the whip so it has less chance of rebounding within an arcing distance from the latch. Also, the bumper 1033*b* can be a resilient material such as rubber that absorbs the force of the whip striking it. This further helps dampen any rebound force that could cause an arc restrike and also limits any shock to the whip 1032 that could damage it.

The latch 1036 of FIG. 14A has a wheel 1036*b* secured to the rod 1036*a* a short distance below the loop 1036*c*. As the switch arms 12*a* and 12*b* open, the whip 1032 makes sliding conductive engagement with the latch rod 1036*a*. After some movement, the whip 1032 transitions from the latch rod 1036*a* to the wheel 1036*b* (shown in FIG. 14B) and the relation described in connection with FIG. 13 occurs.

As the switch recloses from its fully open position (not shown), the whip and latch come together and make contact before the main switch contacts meet. First the whip 1032 meets the loop 1036*c* of the latch. The whip proceeds to slide around the surface of the loop until it passes onto the rod 1036*a*. It is not necessary for the wheel 1036*b* to play a role in the reclosing process; it should be in a position to perform its role in switch opening and to be where it does not hold up or interfere with the travel of the whip between the loop 1036*c* and the rod 1036*a* during switch closing.

Where a two part whip 832 like those of FIGS. 10, 11, or 12 is used in a device 1030 like that of FIG. 14A, it is advantageous to have the metal part 832*b* of the whip located so it is where the whip is in contact with the latch rod 1036*a* upon initial opening of the switch contacts. Likewise, it is advantageous to have the metal part 832*b* be the whip part that is the first to contact the latch at the loop 1036*c* during switch reclosing. That takes advantage of the durability and arc resistance of the all metal part 832*b* while the lightweight nonmetal tip portion 832*a* of the whip, with its conductive path, can perform its role in speeding separation upon switch opening.

From the foregoing it is believed innovative whips, and whip and latch combinations, for arc extinguishing devices can be made in forms including those with high speed operation capable of interrupting large currents at high voltage (e.g., up to at least 138 kV). Current levels at least twice that of those interrupted by prior all metal whips can be achieved. This improved performance, along with long life, can be provided relatively economically, i.e., with no substantially greater cost of manufacture than prior art devices. Typically, in the past when all metal whips have been inadequate for a particular application, it has been necessary to avoid use of an air break switch with a quick break whip and instead use a much more costly vacuum switch.

One of the advantages of the apparatus innovations presented is that they can be applied substantially as straightforward replacements for prior whips and latches and achieve improved results. However, these innovations also open up new opportunities for arc extinguishing devices that are modified to take even greater advantage of the increased unit strength and flexibility of the improved whips and latch.

The illustrated, and presently preferred, embodiments involve use of tapered whip elements. However, non-tapered elements can also be suitable in embodiments such as those otherwise like FIGS. 3 through 12. Also, the embodiments show whip elements of circular cross-section but other shapes are intended to be included as well. Further, it is to be recognized that some embodiments, e.g., FIGS. 4 through 12, can be practiced with a solid, rather than hollow, non-metal portion. Similarly, a metal portion of a whip, such as portion 832*b* of FIG. 10 may, broadly speaking, be solid or hollow.

In embodiments such as FIGS. 10, 11, and 12 a preference exists for having the metal portion 832*b* extend at least to the arcing regions on initial switch closing and opening but that is not intended to preclude embodiments in which the metal portion of a two-part whip only extends from the base of the whip to a distance short of that of those arcing regions. In such alternative embodiments, the metal portion can still contribute to high speed separation by attaining higher spring force.

In the description of various embodiments, for example, FIG. 5, reference is made to the fact a rod 341 may be either a single nonmetal rod or an outer rod of a rod assembly such as assembly 40 of FIG. 2A. It should be recognized that where a single nonmetal rod is used it may, if desired, have a greater wall thickness than the described rods such as rod 41, and alternatively, may be solid.

While various forms of the invention herein can be practiced with a unitary whip having a member of material (e.g., nonmetal, such as FRP, with an applied surface conductor) over the whole length of the whip, two-part whips have the extra qualities described above and further expand the opportunity for achieving a desired level of performance characteristics from a wider choice of materials. For example, as one general form of whip, one may have a base portion, the part with attachment to a switch contact or contact arm, of a first composition and a tip portion, that being the part last to separate from the latch or hook of the arc extinguishing device, of a second composition. Both portions include a conductive surface but the composition of the first portion (e.g., an all-metal, such as a copper beryllium alloy) is chosen to have an appreciably greater durability in withstanding arcing between it and a latch upon initial switch opening and closing than the second composition might have. Also, the composition of the second portion (e.g., FRP with an applied conductor) is chosen that has an appreciably greater specific strength (defined in materials engineering as the strength to weight ratio of the material) than the first composition in order to achieve the benefit of higher separation speed with less chance of arc restrikes when the tip of the whip springs away from the latch. A lower density for the second composition, compared to the first composition, is also a general characteristic in such whips.

An MMC material, with or without an applied conductor, is also an example of a material that can meet the criteria mentioned for the second composition, even though it is at least partially of metal in its interior.

Additional embodiments of the invention include those illustrated in FIGS. 15, 16, 17, 18A, 18B, 18C, 18D, 19A, 19B, and 19C.

Figure 15:
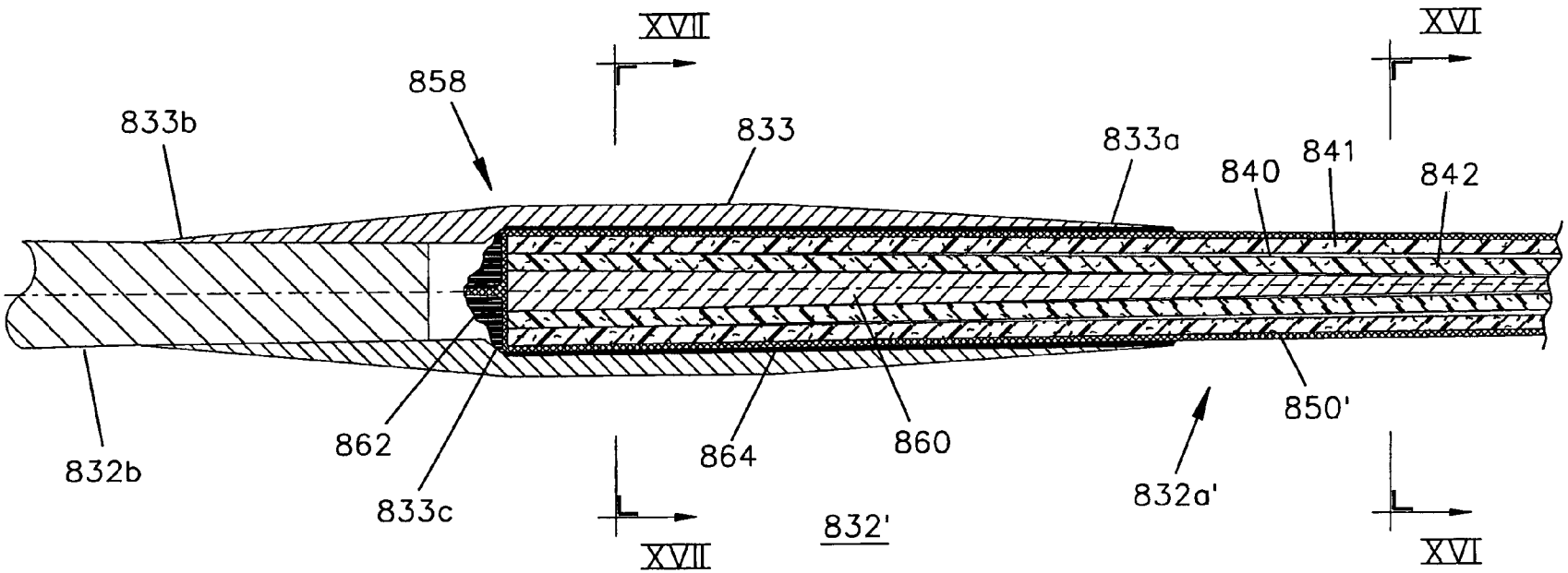
FIG. 15 is an enlarged partial longitudinal section view of a whip embodiment.

FIG. 15 shows details of a whip 832' that includes a whip portion 832*a*' with a nonmetallic rod assembly 840 (having rods 841 and 842) with conductors 850' on the surface of the rod assembly 840 including a metal braid conductor, similar to whip portion 832*a* of FIG. 12. The presence of another conductor over part of the braid 850', such as some form of the cap or sheath 850*b* shown in FIG. 12 at the tip of the whip, or the wound wire 650*b* shown in FIG. 8, is optional. The whip portion 832*a*' is joined with an all metal whip portion 832*b* at a joint 858 further described below.

Figure 16:
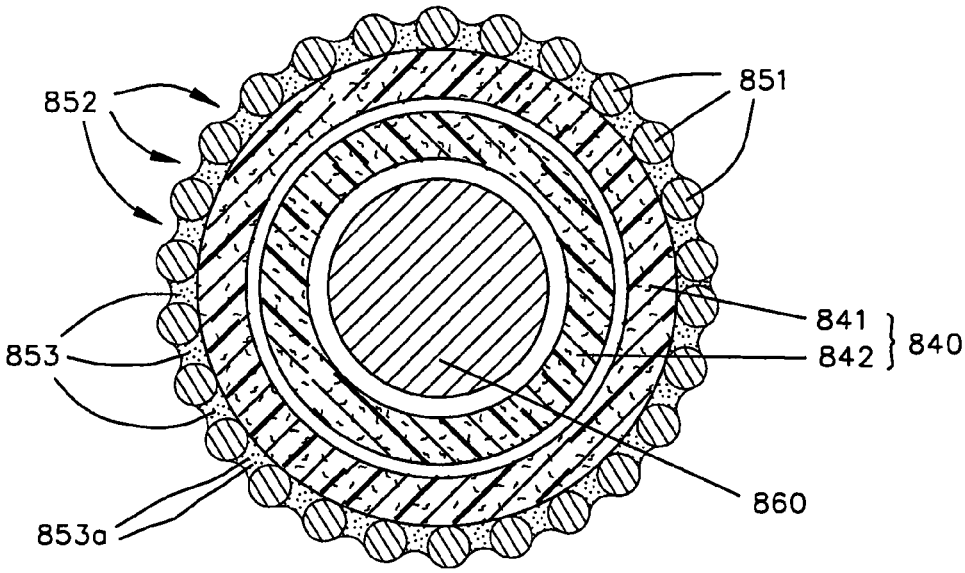
FIGS. 16 and 17 are enlarged transverse sectional views of an embodiment such as that of FIG. 15.

The sectional view of FIG. 16 shows some of the strands 851 of the metal braid 850' not covered by another conductor and with at least some gaps (interstitial sites) 852 between some of the strands 851. In this embodiment, the gaps 852 are sites at which an adhesive 853 is located that bonds at least some of the strands 851 of the braid 850' to the exterior of the rod assembly 840.

The adhesive 853, for example, includes a resinous material such as at least one selected from the group consisting of epoxy resin, urethane resin, and silicone resin. Also, in this example, the adhesive 853 contains metal particles

853*a*, however, an adhesive 853 without metal particles can be acceptable. Such resinous adhesives with varying amounts of metal particles contributing to conductivity are widely commercially available.

An embodiment can, for example, include a braid 850' of a commercially available tubular metal braid as previously described. More generally, the strands 851 can be of a wire or multiple wires, individually or overlappingly disposed around or along the rod assembly 840.

A benefit that can be attained from embodiments like that of FIG. 16 is a longer life, over a significantly greater number of switching operations, of the conductor 850' compared to the same conductor applied to the rod assembly 840 without bonding. Stated differently, the adhesive bonding 853, which adds an insignificant amount of weight to the whip structure, can make it more practical to select the conductive strands 851 from more conductive metal, such as silver, rather than more durable but less conductive metal, such as stainless steel. The strands 851 bonded to the rod surface are less susceptible to tearing in the operation of a quick break whip arc extinguishing device.

For these purposes, the conductor such as braid 850' can be applied directly to the surface of the nonmetal material, such as FRP, of the rod assembly 840. While the presence of some conductive or nonconductive adhesive layer directly under the braid is an option, it is not considered necessary and might itself be damaged (e.g., partially wiped off) during the placement of the rod assembly 840 into the tubular braid. A convenient but effective assembly method is to put a rod assembly 840 with a bare surface into a tubular metal braid 850', crimp the braid ends at the ends of the rod, and apply (e.g., by painting) the adhesive over the braid 850' with some of the adhesive 853 reaching the rod surface to bond the strands 851 to the surface.

Metal particles 853*a*, if used in the adhesive 853, can be favorable to the conductivity of the overall combination but even so such an adhesive 853 normally has lower conductivity than the braid 850'. Consequently, after the above-mentioned steps in forming the assembly, it is also favorable to go over the outermost surface of the braid 850' with a lightly applied solvent to make the braid surface substantially free of the adhesive 853 (yet having the adhesive retained in the gaps 852 as shown).

An additional benefit can be obtained from the combination of the strands 851 and the adhesive 853. The strands wear from their contact with the latch in operation of a switch, and are reduced in thickness as a result. The adhesive 853 between strands can make some sliding contact with the latch that helps provide an increased bearing surface to relieve the bearing force of the latch on the strands 851. This factor can contribute to achieving a greater number of switch operations, in addition to the adhesive reducing tearing of the strands.

The described bonding of metal strands (e.g. metal braid) to a nonmetal rod surface is of benefit for a whip that has a nonmetal with a surface conductor over its entire length as well as for a two part (all-metal portion 832*b* and nonmetal portion 832*a*') whip with a joint between the portions. FIG. 16 illustrates the structure outside the joint 858 where a latch of an arc extinguishing device will make sliding contact, preferably direct contact, to the surface of the strands 851.

Figure 17:
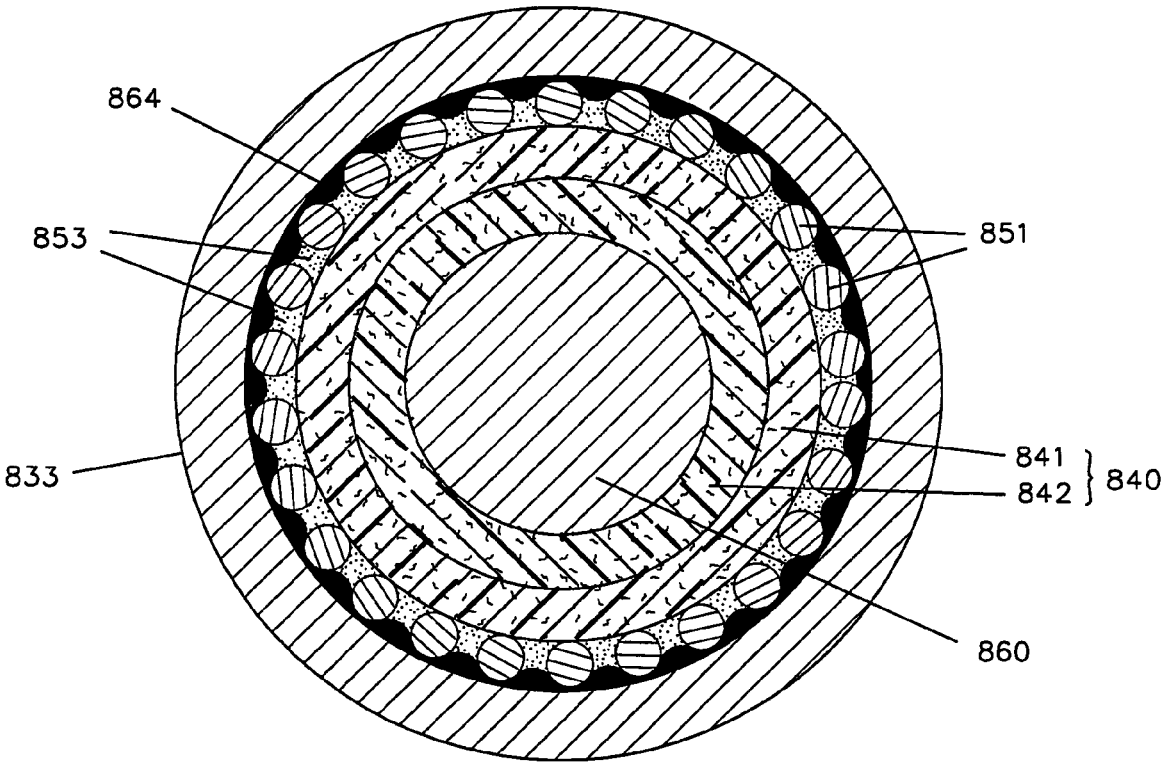

Referring again to FIG. 15, there is shown an enlarged portion of a whip 832' with a joint 858 between first and second portions 832*b* and 832*a*' (all-metal and nonmetal rods) similar to those more generally shown in FIG. 11 or 12. A cross-section of the joint 858 is shown in FIG. 17. In FIG. 15 the blunt end of the nonmetal whip portion 832*a*' is in a metal socket 833 at the smaller end of the metal whip portion 832*b*. In this example the nonmetal portion 832*a*' includes a rod assembly 840 of two nonmetal (e.g. FRP) rods 841 and 842 (while not precisely to scale, FIG. 15 is closer to actual scale than the multiple rods of the view of FIG. 2A in order to illustrate the relative narrowness of the tubular hollow of the inner rod 842 of the assembly 840). Within the tubular hollow of the inner rod 842 there is a metal spine 860 in the portion of the rod 842 in the socket 833 and extending a distance beyond the socket 833. There can optionally be some other number of the rods in the rod assembly 840; in general, there is at least one. The rods of the rod assembly 840 fit tightly together to each other and the inner rod 842 fits tightly on the metal spine 860 at their ends within the joint 858, as shown in FIG. 17. The rods 841 and 842 and the metal spine 860 have a slight taper resulting in their separation as shown in FIG. 16 that becomes greater outside of the socket. Within the joint 858 there may be adhesive bonding between the rods 841 and 842 and between the inner rod 842 and the spine 860. With or without such an interlayer adhesive, the ends of the elements 841, 842 and 860 are firmly joined within the socket 833. Generally, it is preferred that the rods 841 and 842 and the spine 860 otherwise not be bonded, such as in the spaces between them in FIG. 16, for the sake of better spring action of the whip.

Conductors on the rod assembly 840 in a joint 858 as shown in FIG. 15 can include any of those previously described of which the metal braid 850' is an example.

The metal spine 860 has been found favorable to use in combinations of metal and nonmetal whip portions 832*b* and 832*a* or (832*a*') for increased strength of the nonmetal portion 832*a* at the blunt end joined to the metal portion 832*b*, particularly at an axial position 833*a* where the nonmetal portion 832*a* exits the socket 858. At that location there is a high stress when the two-part whip 832' releases from the latch of an arc extinguishing device, such as latch 36, 1036, 1136, or 1236 in the illustrated embodiments. A metal spine 860 considerably enhances the durability of the whip 832' and makes it considerably less likely for breakage of the whip to occur in operation. The spine 860 helps to distribute the stress. The metal spine 860 is, thus, intended for mechanical durability and does not need to play an electrically conductive role in the structure.

A metal spine is also desirable to use in joints like that of FIG. 12 with a bore in an end of the all-metal whip portion 832*b* as well as those with a sheath-like socket 833 applied around the ends of both portions 832*a* and 832*b*.

By way of further example, the metal spine 860 can be a piece of spring steel, such as a music wire; and the socket 833 can be a tubular piece of conductive metal, such as stainless steel or copper-beryllium alloy. The socket 833 is formed with thin front and back edges 833*a* and 833*b* in this example so a latch sliding over the joint 858 can smoothly transition onto and off of the socket. In its manufacture, the socket 833 is formed with an internal stop or shoulder 833*c*. To assemble the parts, an assembly pin (not shown) is inserted into the socket 833, from the right end in FIG. 15. The assembly pin is sized to fit easily within the socket 833 until it reaches the shoulder 833*c* and is stopped. Then the pin serves as a handle for placement of the left end of the socket 833 over the end of the all-metal rod 832*b*. The left end of the socket 833, with the edge 833*b*, is then press fit or hammered onto the rod 832*b* to achieve both physical tightness and conductive continuity.

Continuing with the example of assembly, after the rod 832*b* and socket 833 are so joined, the assembly pin is removed from the socket and the blunt end of the whip portion 832*a*' is inserted, including the rod assembly 840, conductor 850', and spine 860, with bonding as shown in FIG. 16 and also at the end 862. An adhesive (e.g. epoxy) bond 864 also occurs between the socket 833 and the whip portion 832*a*'. A continuous conductive path between the surface conductor 850' with the socket 833 is achieved by the conductivity of the bonding material between them or by crimping the socket edge 833*a* directly onto the conductor 850', or both.

Figure 18A:
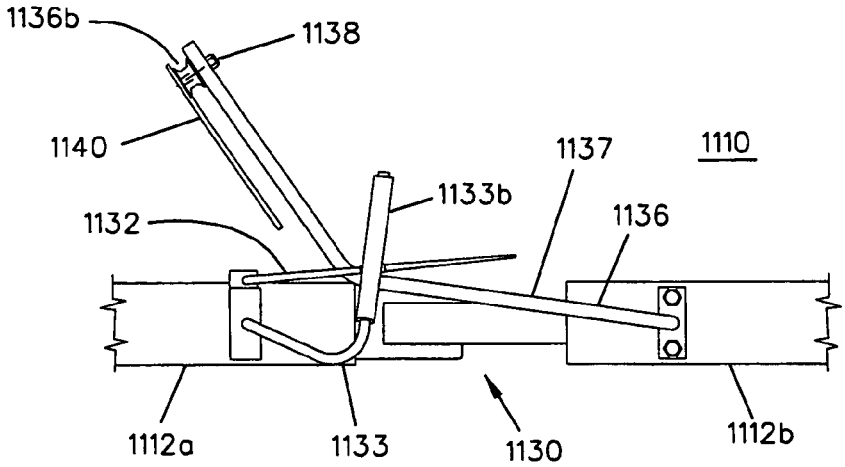
FIGS. 18A and 18B are, respectively, a partial plan view and a partial elevation view of a center break switch with an arc extinguishing device.
Figure 18B:
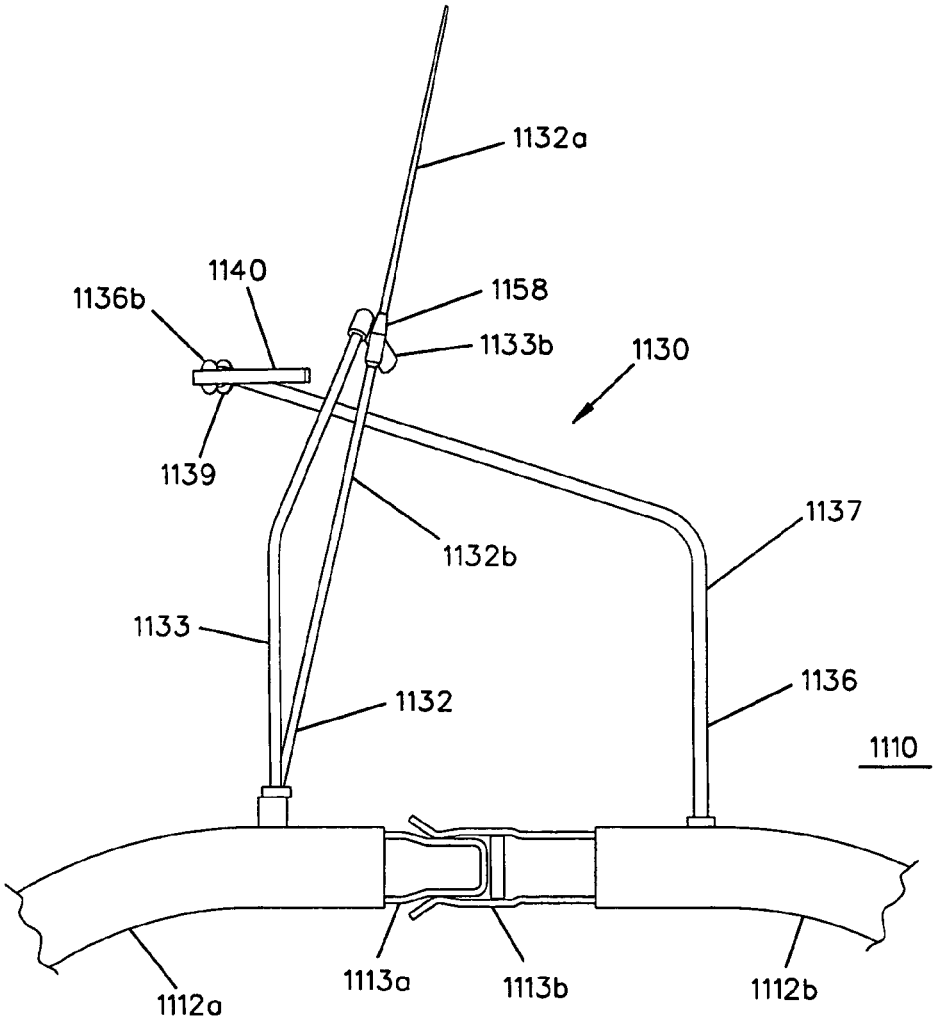

FIGS. 18A and 18B show an electrical apparatus, such as an air break switch 1110 generally like the switch 10 of FIG. 1A, with an improved arc extinguishing device 1130. The device 1130 includes a first contact element (or whip) 1132 with a flexible whip-like structure that includes, at least in part, a rod of material with a conductive path along a length of the rod. The whip 1132 may be as previously described in the present application or U.S. Pat. No. 6,392,181, among others. For example, the whip 1132 can have a structure as disclosed in commonly assigned copending application Ser. No. 10/431,700, filed May 8, 2003, which includes, at least in part, a metal matrix composite material. As another example, the whip 1132 can be all metal in a solid or tubular form. Below will be found description of preferred embodiments of the whip 1132 with two parts 1132*a* and 1132*b* of different composition but, more generally, the device 1130 can have a whip of a rod of one or more parts with a surface conductive path along their length.

The device 1130 also includes a second contact element (latch or hook) 1136 with a rod portion 1137 at one end of which is joined an end of a pin 1138 on which a roller (or wheel) 1136*b* with an outer rim 1139 (e.g., with a circumferential groove) is located and is free to rotate, a second end of the pin 1138 being joined with a cam bar 1140. All the parts of the latch 1136 are conductive. For example, the rod 1137, the pin 1138 and the cam bar 1140 can be of stainless steel or copper-beryllium alloy while the roller 1136*b* can be of any such metal or, at least its rim portion 1139, of a conductor such as carbon for its self-lubrication and arc resistance properties.

The whip 1132 and the latch 1136 are respectively conductively attached to first and second relatively movable electrically conductive parts (e.g., switch contacts 1113*a* and 1113*b* on respective contact arms 1112*a* and 1112*b*) in a combination in which (in the case of a center break switch 1110) the switch arms 1112*a* and 1112*b* are movable from a first, closed, switch position (as shown in FIGS. 18A and 18B) to a second, open, switch position, or vice versa, during which the whip 1132 and the latch 1136 make sliding conductive engagement with each other.

Figure 18C:
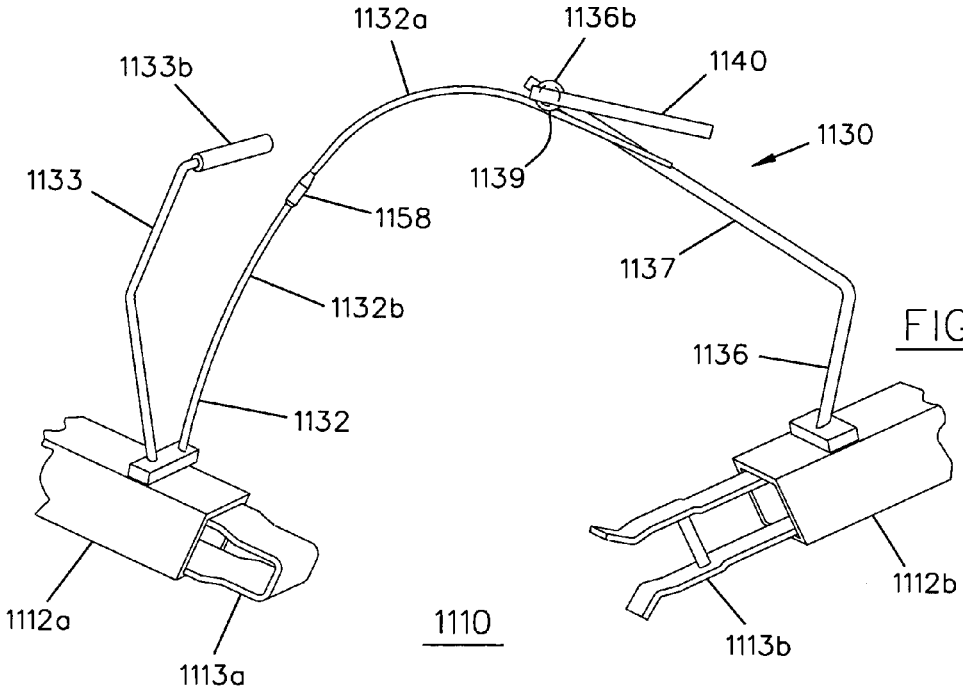
FIG. 18C shows part of the switch of FIGS. 18A and 18B at a position during a switch opening operation.

The sliding conductive engagement includes, during a switch operation from closed to open positions, engagement of the conductive path on the whip 1132 with the rim 1139 of the roller 1136*b* of the latch 1136, as illustrated in FIG. 18C.

In some preferred forms, the whip 1132 includes parts 1132*a* (such as of a nonmetal having a conductive surface) and an all-metal base portion 1132*b* (solid or tubular) such as the two part whips shown in FIGS. 10, 11, 12, or 15. In such cases, the configuration of the elements 1132, 1136, 1112*a* and 1112*b*, and their relative motion is such that, in an opening operation, sliding conductive engagement occurs first between the all-metal portion 1132*b* of the whip and the rod portion 1137 of the latch 1136. Subsequently, there may, or may not, be contact of the metal portion 1132*b* with the roller rim 1139 but there is at least some contact of the conductive path on the second whip portion 1132*a* with the rim 1139 that continues until the whip 1132 is fully released from the latch 1136.

Figure 18D:
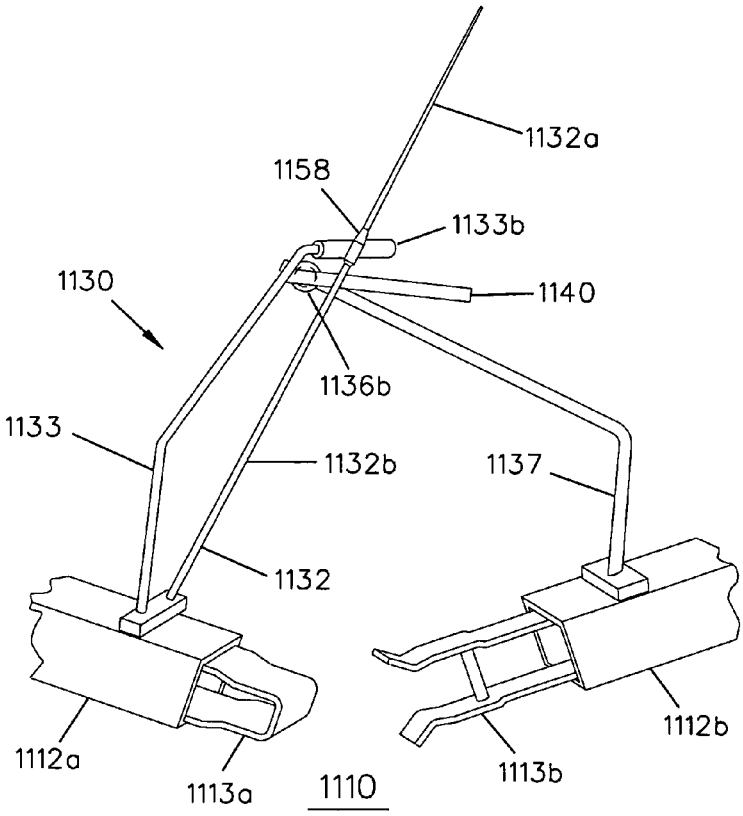
FIG. 18D shows part of the switch of FIGS. 18A and 18B at a position during a switch closing operation.

With such a two-part whip in a device 1130, in going from an open to a closed position of the switch, there is contact first by the metal portion 1132*b* with the cam bar 1140 (as shown in FIG. 18D) and then the rod portion 1137 of the latch 1136. The cam bar 1140 helps make sure the conductive path on the second whip portion 1132*a* avoids the wheel and other parts of the latch, during a closing operation. That way the whip portion 1132*a* can be designed for effective spring action in a switch opening without having wear or damage incurred to it in a switch closing.

The arc extinguishing device 1130 also includes, as an optional feature, a bumper rod 1133 with a bumper 1133*b* that lessens rebounding of the whip 1132 in the manner described in connection with FIG. 14C for bumper rod 1033. The bumper 1133*b*, in this example, is located where a joint 1158 between the two whip parts 1132*a* and 1132*b* will strike the bumper 1133*b*. The joint 1158 may be of any of the types previously described.

The device 1130, as shown in this example, does not include voltage stress relieving loops at the ends of the latch 1136 and the bumper rod 1133 like those shown (elements 1036*c* and 1033*c*) in FIG. 14A for device 1030. Some form of each of such loops is an option for the device 1130. The latch 1036 of FIG. 14A, with the loop 1036*c*, integrally joined with the latch rod 1036*a*, has a part for camming the whip onto the main latch rod portion past the wheel. In the device 1130, with the cam bar 1140 joined to the roller pin 1138 on the side opposite where the pin is attached to the latch rod 1137 and without a loop portion of the rod 1137 extending beyond the wheel 1136*b*, the transition of the whip 1132 to the rod 1137 past the wheel during a closing operation can be effectively achieved and, during an opening operation, incidental arcing between the whip tip portion 1132*a* and such a loop is completely avoided.

In the general case, a whip 1132 with two parts 1132*a* and 1132*b* can best utilize parts of contrasting properties. The base portion 1132*b* is preferably chosen for high durability against arcing encountered upon initial switch opening and closing. An all-metal composition as formerly used for whips is satisfactory for that purpose. The tip portion 1132*a* need not have as high a degree of durability (e.g., it may have materials more subject to wear if it were subjected to the same arcing conditions as the base part 1132*b*) and can be selected for lower density and higher specific strength than the base part 1132*b* for the sake of higher separation speeds. The configuration of the latch 1136 with the cam bar 1140 opposite the rod 1137, with the roller 1136*b* inbetween, is a way in which the wear on the tip portion 1132*a* can be minimized, in addition to the benefits of having bonded conductor strands 851, as in the example of FIGS. 15, 16 and 17. The innovative features of the invention can be used individually as well as in various combinations, of which those described are representative.

Figures 19A, 19B, 19C:
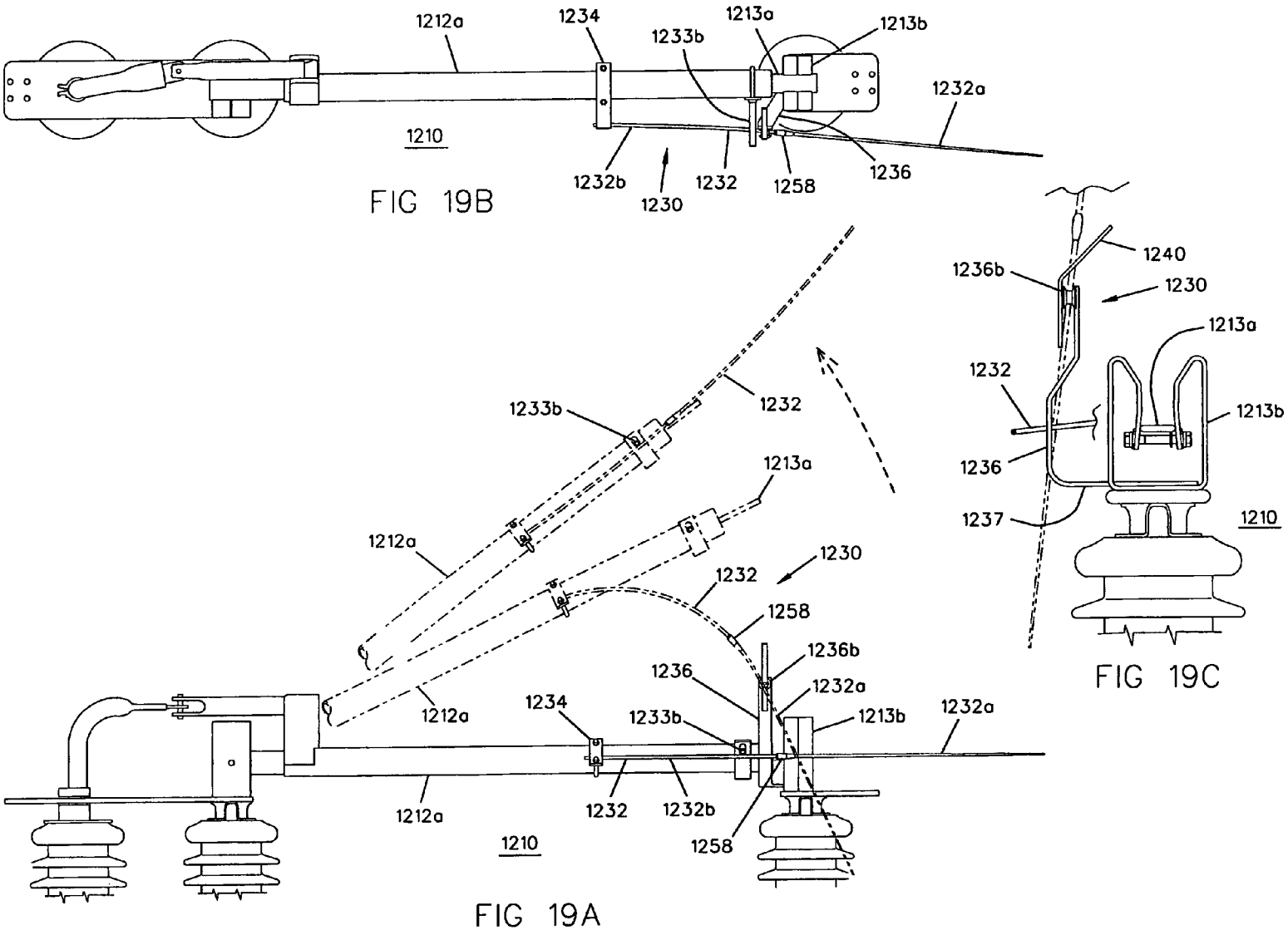
FIG. 19A is a partial elevation view of a vertical break switch with an arc extinguishing device.
FIG. 19B is a top plan view of the switch of FIG. 19A.
FIG. 19C is an end elevation view of the switch of FIG. 19A.

FIGS. 19A, 19B and 19C illustrate a vertical break switch 1210 and an arc extinguishing device 1230 with a whip 1232 attached by conductive attachment 1234 to a single movable contact arm 1212*a* and with a latch 1236 attached to a stationary contact 1213*b*. The combination includes a first switch contact 1213*a* on the contact arm 1212*a* that moves in relation to the second contact 1213*b* during switch opening and closing by a switch operating mechanism (not shown) that can be as previously used in vertical break switches.

The whip 1232 has parts 1232*a* and 1232*b*, corresponding generally to the parts of whip 1132 in the preceding embodiment, with a joint 1258. The latch 1236 has parts 1237, 1236*b* and 1240 (best seen in FIG. 19C) that correspond generally to parts 1137, 1136*b* and 1140 of the preceding embodiment.

Although, in contrast to the center break switch, relative motion of the contacts 1213*a* and 1213*b* is by movement of just one contact arm 1212*a*, the whip 1232 and latch 1236 of FIGS. 19A, B, and C cooperate on switch opening and closing substantially like the whip 1132 and latch 1136 of FIGS. 18A, B, C, and D.

The solid lines show the elements in a closed position of the switch 1210. FIG. 19A additionally shows in dashed lines the moveable contact arm 1212*a* and the whip 1232 at two positions during upward movement of the contact arm 1212*a* in a switch opening operation. In the first (lower) position of the moving contact arm 1212*a*, contacts 1213*a* and 1213*b* are separated and the whip 1232, specifically whip portion 1232*a*, is engaging the latch 1236 at the wheel (or roller) 1236*b*. The dashed lines in FIG. 19C likewise show the whip portion 1232*a* engaging the wheel 1236*b*. Upon further upward movement of the contact arm 1212*a*, as shown in the upper position of the arm in FIG. 19A, the whip 1232 has released from the wheel 1236*b* and sprung away from the latch 1236 for rapid are extinction. In this embodiment, a bumper 1233*b* limits motion of the whip 1232 and absorbs energy to minimize the likelihood of the whip portion 1232*a* rebounding back toward the latch 1236 far enough to allow rearcing to occur.

When the switch 1210 is fully open, normally the contact arm 1212*a* is perpendicular to its original closed position. In a switch closing, the arm 1212*a* is moved down back to the closed position shown with the whip portion 1232*b* contacting, first, the cam bar 1240 of the latch 1236 and, upon further movement, the rod portion 1236 of the latch. During the closing operation, the bumper 1233*b* helps to press the whip portion 1232*b* against the latch elements (as does the bumper 1133*b* of the preceding embodiment).

The embodiments disclosed are merely some examples of the various ways in which the invention can be practiced.

What is claimed is:

1. An electrically conductive whip-like contact structure comprising:

a flexible rod;

a conductive path along an exterior surface of the rod, the conductive path including one or more metal conductors selected from the group consisting of a metal braid and a metal wire, the one or more metal conductors including metal strands bonded to the rod surface by an adhesive at interstitial locations between the metal strands and the adhesive includes a resinous material containing metallic particles.

2. The structure of claim 1 where:

the rod is tapered and comprises a nonmetallic material;

the one or more metal conductors have greater conductivity than the adhesive;

the conductive path is formed principally of a tubular metal braid directly on the exterior rod surface with the adhesive bonding between sides of strands of the braid and the rod surface and with the outermost, exposed, surface of the metal strands substantially free of the adhesive;

the flexible rod is a first rod in a rod assembly with at least a second tapered rod located within a part of the first rod and the rods have blunt ends secured together at a common axial position; and, in addition, a metal rod portion has an end joined with the blunt ends of the rods in the rod assembly with the conductive path on the first rod of the rod assembly conductively connected with the metal rod.

3. The structure of claim 1 where:

the adhesive includes at least one resinous material selected from the group consisting of epoxy resin, urethane resin, and silicone resin and contains metal particles.

4. The structure of claim 3 where:

the rod is tapered and principally comprises fiber-reinforced plastic material.

5. The structure of claim 4 where:

the one or more conductors have greater conductivity than the adhesive; and the outermost, exposed, surface of the metal strands is substantially free of the adhesive.

6. The structure of claim 5 where:

the conductive path is formed principally of a tubular metal braid directly on the exterior rod surface with the adhesive on the exterior rod surface at at least some of the interstitial locations between the strands.

7. The structure of claim 4 where:

the flexible rod is a first rod in a rod assembly with at least a second tapered rod located within a part of the first rod and the rods have blunt ends secured together at a common axial position.

8. The structure of claim 7 further comprising:

a substantially all-metal rod portion having an end joined with the blunt ends of the rods in the rod assembly with the conductive path on the first rod of the rod assembly conductively connected with the all-metal rod.

9. The structure of claim 8 further comprising:

a metal spine within at least the blunt end of the rod assembly with an innermost rod of the rod assembly joined together with the metal spine.

10. The structure of claim 9 where:

the rods of the rod assembly all principally comprise fiber-reinforced plastic material; and a joint between the end of the all-metal rod portion and the ends of the rods of the rod assembly comprises a metal socket over the joined ends with the ends of the rods of the rod assembly and the metal spine firmly joined together.

11. An electrically conductive whip-like contact structure comprising:

a tapered, elongated, and flexible member including first and second parts with an end of the first joined with an end of the second and with a taper proceeding along the member with smaller cross-sectional dimensions from a largest end of the first part to a smallest end of the second part;

the first part being of substantially all-metal material;

the second part having a different composition than the first part with a density less than that of the first part; and the first and second parts each having an electrically conductive surface forming a continuous conductive path along the outside of the joined parts with the conductive path exteriorly exposed for contact along its length.

12. The structure of claim 11 where:

the second part includes a tapered rod of nonmetallic material having one or more metal conductors thereon making up its electrically conductive path along the outside thereof; and the second part is joined with the first part at a joint including a metal spine located within a central tapered hollow of the second part from a first axial point near the first part to a second axial point outside of the joint between the first and second parts.

13. The structure of claim 12 where:

the metal spine is tapered in the same direction as the second part and is a member of a spring steel.

14. The structure of claim 12 where:

the rod of nonmetallic material of the second part principally comprises fiber-reinforced plastic material and is a first rod in a rod assembly that has, within the central hollow of the first rod, at least a second tapered, tubular rod that also principally comprises fiber-reinforced plastic material; and the rod assembly, in a portion proximate the first part of the flexible member, has the rods thereof fit tightly together and an innermost rod of the rod assembly over a part of its length fits tightly together with the metal spine located within it.

15. The structure of claim 14 where:

the one or more metal conductors on the second part include at least one conductor selected from the group consisting of a metal braid and a metal wire adhesively bonded to the surface of the first rod of nonmetallic material.

16. The structure of claim 11 where:

the composition of the second part also has a greater specific strength than the all-metal material of the first part.

17. The structure of claim 16 where:

the composition of the second part comprises a member selected from the group consisting of fiber reinforced plastics and metal matrix composites; and the material of the first part comprises a member selected from the group consisting of beryllium-copper and stainless steel.

18. The structure of claim 12 where:

the first part is a metal spring rod and the second part is a rod of fiber reinforced plastic polymer with a surface conductor comprising a wound wire or wire braid bonded to the polymer rod by a flexible conductive polymer adhesive; and the first part and the second part are such that the first part imparts accelerating force to the second part after release of the second part from conductive engagement with another contact element during which the first part and the second part have been flexed.

19. Electrical apparatus comprising:

a first contact element with a flexible whip-like structure including a rod with a conductive path along at least a surface of the rod;

a second contact element that includes a rod portion having an end proximate to which there is joined with the rod portion a first end of a pin on which a roller, with an outer rim, is located and free to rotate, a second end of the pin being joined with a cam bar, and the rod portion, pin, roller, and cam bar all being electrically conductive;

the first and second contact elements being conductively attached respectively to first and second relatively movable electrically conductive parts in a combination in which the first and second electrically conductive parts are relatively moveable from a first position to a second position and from the second position to the first position during which movements the first and second contact elements make sliding conductive engagement including, in movement from the first position to the second position, sliding conductive engagement of the conductive path of the first contact element with the rim of the roller of the second contact element.

20. The electrical apparatus of claim 19 where:

the rod of the first contact element includes a tip portion of a nonmetallic material having one or more conductors on its surface that is joined with an end of an all-metal base portion with continuous conductivity between the base portion and the conductive path on the tip portion and an opposite end of the base portion is joined with the first relatively movable electrically conductive part;

the combination being arranged so that, in a movement from the first position to the second position, sliding conductive engagement of the first and second contact elements occurs between the base portion of the first contact element and the rod portion of the second contact element and, subsequently in such movement, between the conductive path on the tip portion of the first contact element and the rim of the roller of the second contact; and, in a movement from the second position to the first position, sliding conductive engagement of the first and second contact elements occurs, in sequence, between the base portion of the first contact element and the cam bar of the second contact element and, subsequently in such movement, between the base portion of the first contact element and the rod portion of the second contact element.

21. The electrical apparatus of claim 20 where:

the nonmetallic material of the tip portion of the first electrical contact principally comprises fiber-reinforced plastic;

the arrangement is such that the conductive path on the nonmetallic material of the first contact element conductively engages the second contact element only at the rim of the roller and only in a movement of the parts from the first position to the second position.

22. The electrical apparatus of claim 20 where:

the first and second relatively movable parts are respective contact arms of an air break switch that each support respective switch contacts; and the movement from the first to the second position is a movement from a closed position to an open position of the switch contacts and a movement from the second position to the first position is a movement from an open position to a closed position of the switch contacts.

23. The electrical apparatus of claim 22 where:

the sliding engagement, during movement from the closed to the open position, of the base portion of the first contact element with the rod portion of the second contact element initially occurs prior to separation of the switch contacts and that of the conductive path on the tip portion of the first contact element with the rim of the roller of the second contact element occurs after separation of the switch contacts.

24. An air break switch comprising:

first and second interengaging switch contacts and a switch operating mechanism for opening and closing operations of the switch contacts by relative movement of the contacts;

an arc extinguishing whip and a latch conductively connected with respective ones of the contacts;

the whip having a first all-metal portion conductively connected with one of the contacts and a second portion comprising one or more concentric rods of material of a different composition than the first portion with a continuous conductive path on an exterior surface of the outermost rod that includes one or more conductors having one or more metal strands bonded to the surface of the rod by an adhesive, and with the conductive path on the outermost rod connected with the first portion at a joint including a metal spine located within the interior of the second portion;

the latch including conductive members comprising a rod portion connected at one end with the other of the contacts and having a second end proximate to which a pin is attached to the rod portion with a roller free to rotate thereon, the latch further comprising a cam bar attached to the pin on a side of the roller opposite the rod portion;

the whip, the latch and the respective contacts being arranged in a combination that has sliding conductive engagement between the whip and the latch during opening and closing operations of the switch contacts by the switch operating mechanism including, in a switch opening operation, sliding conductive engagement of the conductive path on the whip second portion with the roller of the latch.

25. A switch in accordance with claim 24 where:

the one or more rods of the whip second portion comprise fiber-reinforced plastic material;

the one or more metal conductors on the exterior surface of the outermost nonmetallic rod include at least one conductor selected from the group consisting of metal braids and metal wires and the adhesive by which bonding of the conductors to the surface occurs includes a resinous material containing metallic particles;

the one or more nonmetallic rods of the whip second portion are tapered, tubular rods with their one or more blunt ends firmly together at a common axial point within the joint with the whip first portion with each other and with the metal spine which is tapered in the same direction as the nonmetallic rod or rods; and the combination of whip, latch and contacts has sliding conductive engagement during a switch opening operation between the whip first portion and the latch rod portion prior to engagement of the whip second portion with the roller; and the combination of whip, latch and contacts also has sliding conductive engagement during a switch closing operation between the whip first portion and the latch cam bar prior to engagement between the whip first portion and the latch rod portion.

26. A switch in accordance with claim 24 where:

the switch is a center break switch with the switch contacts conductively joined with respective contact arms that both are subject to movement by the switch operating mechanism.

27. A switch in accordance with claim 24 where:

the switch is a vertical break switch with the one of the switch contacts to which the whip is conductively connected being joined with a contact arm subject to movement by the switch operating mechanism while the other switch contact is stationary.

28. A switch in accordance with claim 24 where:

the whip, the latch, and the respective contacts are further arranged such that during an opening operation, after flexing of the whip against the latch and separation of the whip from the latch occurs, an electric arc is drawn between a tip of the conductive path on the whip second portion and the roller of the latch, and during a closing operation an electric arc is drawn between the whip first portion and the cam bar of the latch.

29. An air break switch comprising:

first and second main switch contacts movable relative to each other to produce a switch opening or a switch closing;

a whip and a latch, conductively connected with respective ones of the main switch contacts, that mutually conductively engage at least during part of a switch opening;

the whip having a structure including, at least in a tip-end portion that is last to separate from the latch in a switch opening, a flexible nonmetal rod with a surface conductive path comprising at least one conductor selected from the group consisting of a metal braid, a metal foil, a metal sheath, and a metal wire; and the surface conductive path of the whip tip-end portion extends continuously along the length of the nonmetal rod from its tip to a conductive connection leading to the switch contact to which the whip is conductively connected.

30. The switch of claim 29 where:

the nonmetal rod of the whip tip-end portion contains fiber reinforced plastic.

31. The switch of claim 29 where:

the latch includes a conductive metal rod and a conductive wheel having a circumferential surface; and the whip and latch are arranged for sliding conductive engagement between the surface conductive path of the whip tip-end portion and the circumferential surface of the latch wheel before the whip finally separates from the latch in a switch opening.

32. The switch of claim 30 where:

the nonmetal rod is a first rod in a rod assembly that has, within the first rod with the surface conductive path, one or more additional nonmetal rods arranged within a tapered hollow center of the first rod and firmly joined together at an inner end with an inner end of the first rod and spaced from each other and from the first rod at outer ends of the one or more additional rods.

33. The switch of claim 32 where:

the one or more additional rods each contain fiber reinforced plastic.

34. The switch of claim 33 where:

the latch includes a conductive metal rod and a conductive wheel having a circumferential surface; and the whip and latch are arranged for sliding conductive engagement between the surface conductive path of the whip tip-end portion and the circumferential surface of the latch wheel before the whip finally separates from the latch in a switch opening.

35. The switch of claim 29 where:

the whip has an initial contact region that is first to contact the latch during a switch opening and also first to contact the latch during a switch closing; and the initial contact region has a conductive metal surface of relatively high weight and durability to better withstand arcing during initial switch opening and closing compared to the weight and durability of the conductive path over a majority of the whip tip-end portion.

36. The switch of claim 35 where:

the whip initial contact region is on the portion of the whip including a nonmetal rod and the conductive metal surface of the initial contact region includes some conductive metal in addition to that of the conductive path on the majority of the whip portion including a nonmetal rod; and the nonmetal rod of the whip tip end portion contains fiber reinforced plastic.

37. The switch of claim 34 where:

the latch also includes a conductive latch camming surface in an arrangement with sliding conductive engagement, during a switch closing, between the whip and the latch camming surface and rod without contact of the whip with the wheel.

38. An air break switch comprising:

first and second main switch contacts movable relative to each other to produce a switch opening or a switch closing;

a whip and latch, conductively connected with respective ones of the main switch contacts, that mutually conductively engage at least during part of a switch opening;

the whip having a structure including, at least in a tip-end portion that is last to separate from the latch in a switch opening, a rod assembly of a first flexible nonmetal rod with a surface conductive path and one or more additional nonmetal rods arranged within a tapered hollow center of the first nonmetal rod and firmly joined together at one end with an inner end of the first rod and spaced from each other and from the first at outer, tip, ends of the one or more additional rods; and the surface conductive path of the whip tip-end portion extends continuously along the length of the first nonmetal rod from its tip to a conductive connection leading to the switch contact to which the whip is conductively connected.

39. The switch of claim 38 where:

each of the nonmetal rods of the whip tip-end portion contains fiber reinforced plastic.

40. The switch of claim 38 where:

the latch includes a conductive metal rod and a conductive wheel having a circumferential surface;

the whip and latch are arranged for sliding conductive engagement between the surface conductive path of the whip tip-end portion and the circumferential surface of the latch wheel before the whip finally separates from the latch in a switch opening; and the latch also includes a conductive latch camming surface in an arrangement with sliding conductive engagement, during a switch closing, between the whip and the latch camming surface and rod without contact of the whip with the wheel.

41. The switch of claim 38 where:

the surface conductive path comprises at least one conductor selected from the group consisting of a metal braid, a metal foil, a metal sheath, and a metal wire.

42. The switch of claim 39 where:

the latch includes a conductive metal rod and a conductive wheel having a circumferential surface; and the whip and latch are arranged for sliding conductive engagement between the surface conductive path of the whip tip-end portion and the circumferential surface of the latch wheel before the whip finally separates from the latch in a switch opening.

43. The switch of claim 38 where:

the whip has an initial contact region that is first to contact the latch during a switch opening and also first to contact the latch during a switch closing; and the initial contact region has a conductive metal surface of relatively high weight and durability to better withstand arcing during initial switch opening and closing compared to the weight and durability of the conductive path over a majority of the whip tip-end portion.

44. The switch of claim 43 where:

the whip initial contact region is on the portion of the whip including a nonmetal rod and the conductive metal surface of the initial contact region includes some conductive metal in addition to that of the conductive path on the majority of the whip portion including a nonmetal rod; and the nonmetal rod of the whip tip end portion contains fiber reinforced plastic.

45. The switch of claim 40 where:

the whip has a metal base portion connected at a first end with a movable support of a first main switch contact and at a second end with the tip-end portion with a joint between the base portion and the tip-end portion with the joint providing part of the conductive connection;

the joint between the whip base and tip-end portions is located, in relation with the latch, to provide the conductive engagement, during a switch closing, between only the base portion of the whip with the latch.

46. The switch of claim 45 where:

the rods of the whip tip-end portion contain fiber reinforced plastic and the surface conductive path includes at least one conductor comprising metal strands over the surface of the first rod with interstitial sites between strands where an adhesive bonds sides of the strands with the rod surface, the outermost exposed surface of the strands being substantially free of the adhesive; and the joint between the whip base portion and tip-end portion includes a metal spine located within the interior of the tip-end portion and firmly joined with the innermost rod of the one or more additional nonmetal rods and the joint also includes a metal socket within which the joined ends of the whip portions are firmly located.

* * * * *